US010716737B2

(12) United States Patent
Krezanoski

(10) Patent No.: US 10,716,737 B2
(45) Date of Patent: Jul. 21, 2020

(54) COUNTING DEVICES AND METHODS FOR USING SAME

(71) Applicant: Opportunity Solutions International Inc., San Francisco, CA (US)

(72) Inventor: Joseph Krezanoski, Cambridge, MA (US)

(73) Assignee: Opportunity Solutions International Inc., San Francisco, CA (US)

( * ) Notice: Subject to any disclaimer, the term of this patent is extended or adjusted under 35 U.S.C. 154(b) by 46 days.

(21) Appl. No.: 16/208,525

(22) Filed: Dec. 3, 2018

(65) Prior Publication Data

US 2019/0201292 A1 Jul. 4, 2019

Related U.S. Application Data

(60) Provisional application No. 62/593,869, filed on Dec. 1, 2017.

(51) Int. Cl.

| | |
|---|---|
| ***A61J 7/02*** | (2006.01) |
| ***A61J 1/03*** | (2006.01) |
| ***A61J 7/00*** | (2006.01) |

(52) U.S. Cl.
CPC . *A61J 7/02* (2013.01); *A61J 1/03* (2013.01); *A61J 7/0076* (2013.01)

(58) Field of Classification Search
USPC .... 221/303, 305, 309, 312 C, 283, 285, 1, 7
See application file for complete search history.

(56) References Cited

U.S. PATENT DOCUMENTS

| | | | | |
|---|---|---|---|---|
| 5,878,947 | A * | 3/1999 | Hoy | A47F 1/08 221/305 |
| 6,176,419 | B1 * | 1/2001 | Holley, Jr. | B65D 71/36 221/305 |
| 6,189,778 | B1 * | 2/2001 | Kanter | B65D 5/001 221/305 |
| 2003/0192907 | A1 * | 10/2003 | Bates | B65D 71/36 221/305 |
| 2009/0084808 | A1 * | 4/2009 | Stanley | A61J 7/02 221/1 |
| 2009/0321465 | A1 * | 12/2009 | Knoth | G07F 11/44 221/1 |
| 2010/0155411 | A1 * | 6/2010 | Solari | B65D 83/04 221/87 |
| 2014/0263389 | A1 * | 9/2014 | Perozek | A61J 7/02 221/1 |

* cited by examiner

*Primary Examiner* — Gene O Crawford
*Assistant Examiner* — Ayodeji T Ojofeitimi
(74) *Attorney, Agent, or Firm* — Bekiares Eliezer LLP

(57) ABSTRACT

Disclosed herein are devices and systems for counting medication. In an aspect, the device can include a collapsible container assembly, the assembly comprising: a sheet comprising a plurality of predetermined fold lines, the plurality of predetermined fold lines configured to flex along the fold lines; wherein at least a portion of the sheet is configured to be folded along at least a portion of the fold lines into at least one predetermined shape having a predetermined volume; wherein the container assembly in a folded state is configured to releasably couple or engage a grid for collecting medication; and a grid comprising a plurality of openings, each opening configured to collect a unit of medication having a predetermined size and/or shape. Also disclosed herein are methods of using the disclosed counting devices and systems.

20 Claims, 15 Drawing Sheets

COUNTING DEVICES AND METHODS FOR USING SAME

CROSS REFERENCE TO RELATED APPLICATIONS

This application claims the benefit of priority to U.S. Provisional Patent Application Ser. No. 62/593,869, filed Dec. 1, 2017, which is hereby incorporated herein by reference in its entirety.

FIELD OF INVENTION

The present invention relates to counting devices and systems, such as medication, and methods for using the devices and systems.

BACKGROUND OF THE INVENTION

In developing countries, or in resource-limited environments in high income countries, there is no economical and efficient means to count medication quickly or accurately. This is most apparent when working with the larger medication and prescription counts necessary for managing chronic conditions such as diabetes, hypertension and HIV, all of which are very common. For these chronic conditions, patients receiving between 2-week and 3-month supplies of medication can amount to 60-600 pills. These prescriptions are counted manually with a plastic tray and spatula, which is incredibly time consuming and subject to significant human error, especially when the clinic is understaffed and/or overburdened with prescriptions.

Disasters such as the 2015 Nepal Earthquake highlight environments in which economical and efficient means for counting and dispensing medication would prove highly beneficial. Healthcare workers often receive bulk supplies of donated medicines from around the world, but since there is often a lack of electricity, they are limited to counting medication by hand using a plastic tray and spatula. This method consumes a considerable amount of time for volunteer doctors, nurses, pharmacists, and other personnel whose expertise could be put to better use.

Accordingly, there remains a need for improved devices and systems for counting medication faster and more accurately than manual plastic trays and spatulas. Additionally, the devices and systems should be manual, easy to use and transport. This need and other needs are satisfied by the various aspects of the present disclosure.

SUMMARY OF THE INVENTION

In accordance with the purposes of the invention, as embodied and broadly described herein, the invention, in one aspect, relates to counting devices and systems, such as, for example for counting medication. In further aspects, the device can comprise: a collapsible container assembly, the assembly comprising: a sheet comprising a plurality of predetermined fold lines, the plurality of predetermined fold lines configured to flex along the fold lines; wherein at least a portion of the sheet is configured to be folded along at least a portion of the fold lines into at least one predetermined shape having a predetermined volume; wherein the container assembly in a folded state is configured to releasably couple or engage a grid for collecting medication; and a grid comprising a plurality of openings, each opening configured to collect a unit of medication having a predetermined size and/or shape.

In another exemplary aspect, the invention relates to a device comprising: a collapsible container assembly, the assembly comprising: a plurality of panels sheet, at least a portion of the panels connected by predetermined fold lines, the predetermined fold lines configured to flex along the fold lines; wherein at least a portion of the panels are configured to be folded along at least a portion of the fold lines into at least one predetermined shape having a predetermined volume; and wherein the container assembly in a folded state is configured to releasably couple or engage a grid for collecting medication; and a grid comprising a plurality of openings, each opening configured to collect or receive a unit of medication having a predetermined size and/or shape.

In further aspects, the invention also relates to methods for using the disclosed devices and systems, for example, for counting and dispensing medication.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several aspects of the invention and together with the description, serve to explain the principles of the invention.

DETAILED DESCRIPTION OF THE INVENTION

Figure 1A:
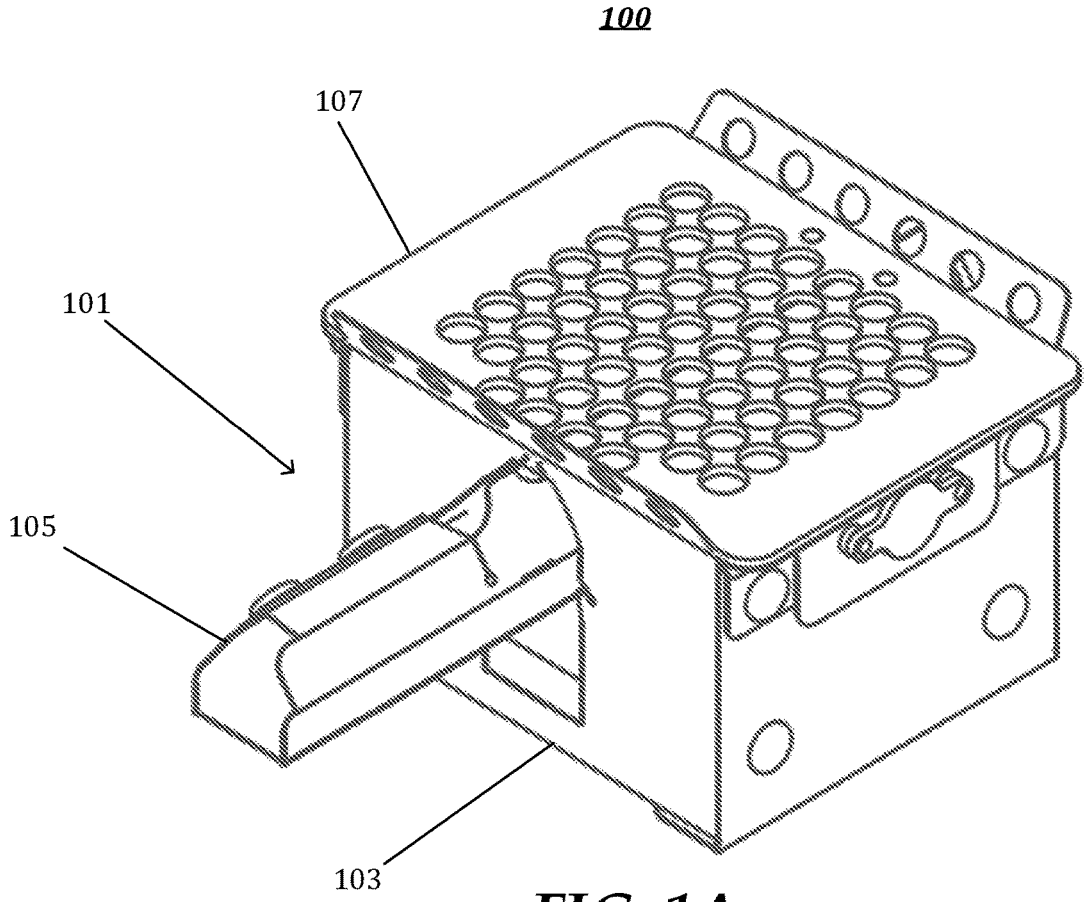
FIGS. 1A-1D show depictions of a counting device in accordance with an exemplary embodiment of the present invention.
Figure 1B:
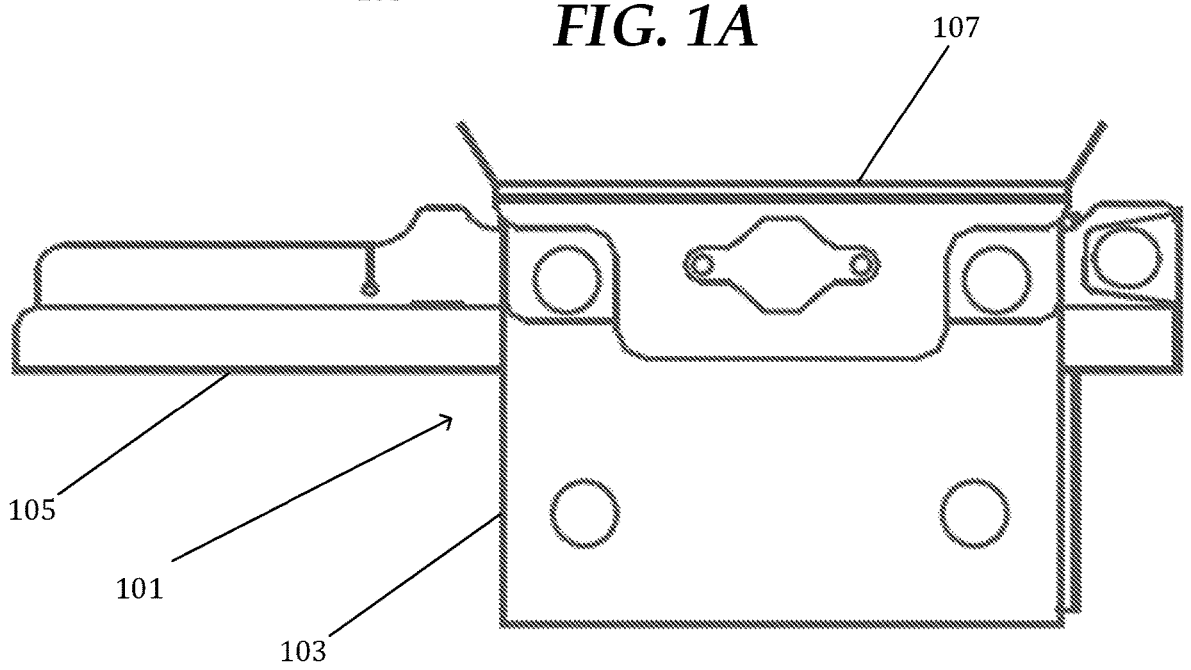
Figure 1C:
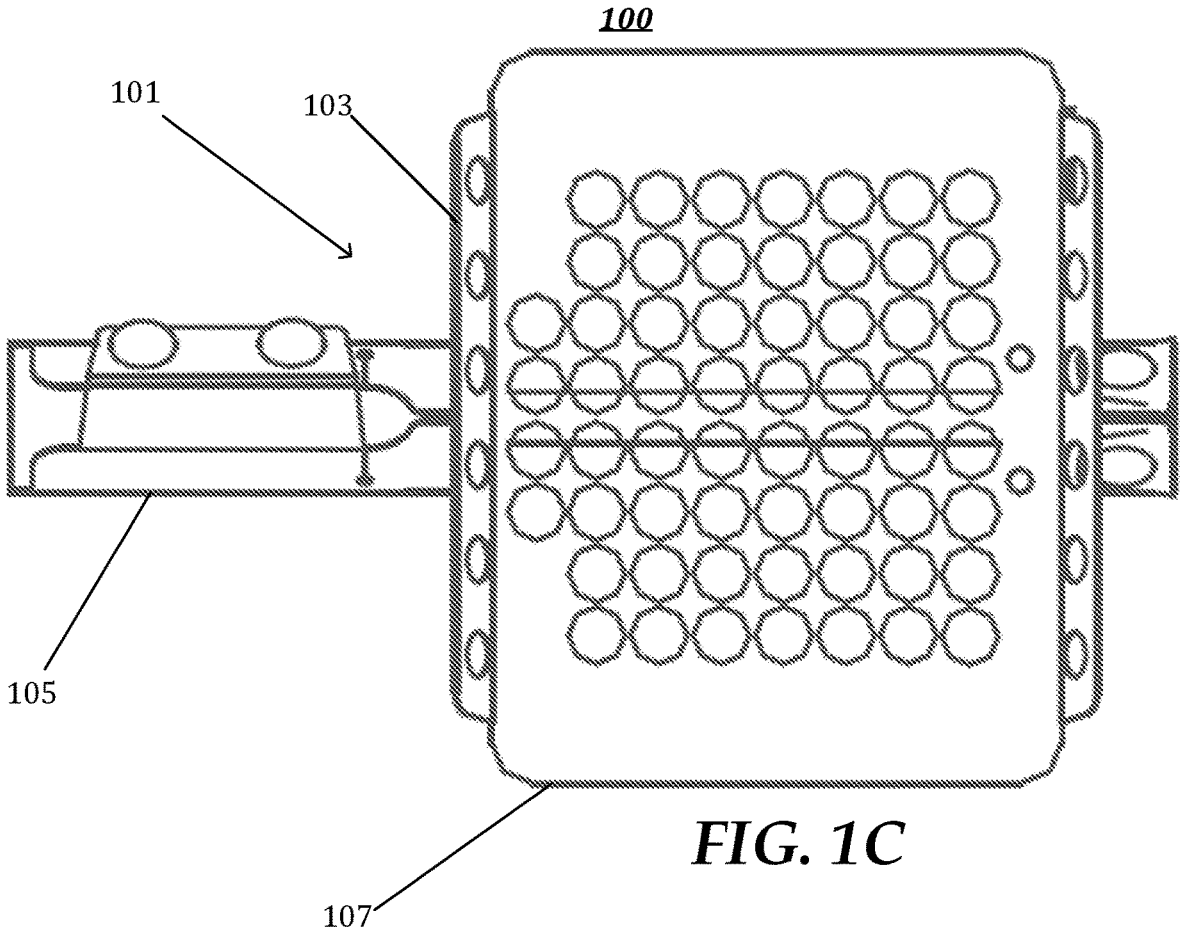
Figure 1D:
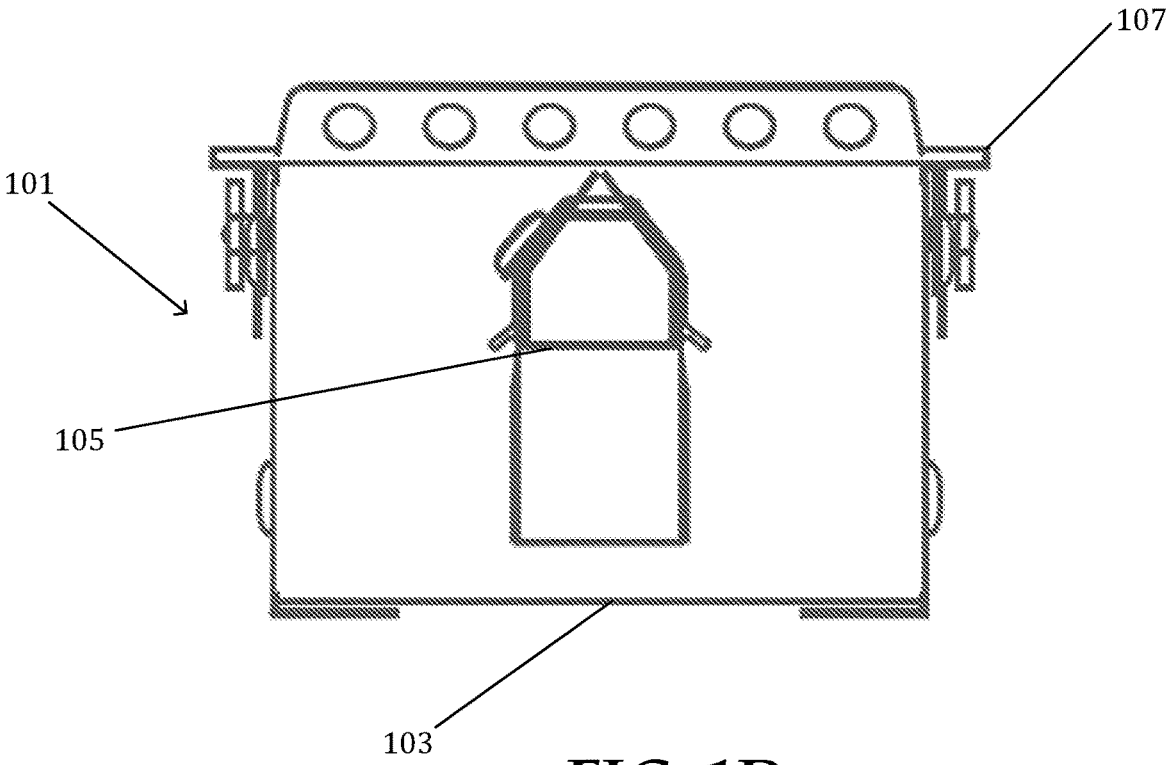

The present invention can be understood more readily by reference to the following detailed description of the invention and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims, which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the invention as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the invention. Thus, if there are a variety of additional steps that can be performed it is understood that each of these additional steps can be performed with any specific aspect or combination of aspects of the methods of the invention.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Counting Devices and Systems

As briefly described above, the present disclosure relates, in various aspects, to counting devices, apparatuses, and systems for counting and dispensing medication, such as pills, tablets, capsules, unit-dose medication or the like. In one aspect, the present disclosure provides a counting device for medication. In further aspects, the device can comprise a handheld, non-electric medication counting device. In still further aspects, the device can effectively solve the challenge of quickly and accurately counting medication (e.g., pills) for prescriptions greater than 30 pills. In yet further aspects, the device can be used for batch counting prescriptions from bulk bottles of pills. In even further aspects, the device can be can be configured to be completely flat, which can allow many devices to be shipped in a small space.

In further aspects, the disclosed devices can count prescriptions that have pill quantities over 30 pills with far greater accuracy and speed than current manual devices and methods. In still further aspects, the device can be useful for making 16-prescriptions of 60 pills each from a 1000-pill bottle in one counting session. In yet further aspects, the disclosed devices can utilize visual recognition rather than the more tenuous cognitive task of counting large quantities. In even further aspects, the device accuracy and speed are less affected by environmental distractions or noise.

In another aspect, the present disclosure provides a device for counting medication, the device comprising: a collapsible container assembly, the assembly comprising: at least one sheet comprising a plurality of predetermined fold lines, the plurality of predetermined fold lines configured to flex along the fold lines; wherein at least a portion of each sheet is configured to be folded along at least a portion of the fold lines into at least one predetermined shape having a predetermined volume; and a grid plate comprising a plurality of grid openings or wells, each opening configured to collect or retain a unit of medication having a predetermined size and/or shape; wherein the container assembly in a folded state is configured to releasably couple or engage the grid plate for collecting medication.

In another aspect, the present disclosure provides a device for counting medication, the device comprising: a collapsible container assembly, the container assembly comprising a plurality of panels connected by predetermined fold lines, the predetermined fold lines configured to flex along the fold lines; wherein at least a portion of the panels are configured to be folded along at least a portion of the fold lines into at least one predetermined shape having a predetermined volume; and a grid plate comprising a plurality of grid openings, each opening configured to collect or receive a unit of medication having a predetermined size and/or shape; and wherein the container assembly in a folded state is configured to releasably couple or engage the grid plate for collecting medication.

In another aspect, disclosed herein is a device for counting and dispending medication, the device comprising a collapsible container assembly, the container assembly comprising: a collapsible body assembly and a collapsible handle assembly, wherein each of the body assembly and the handle assembly comprise at least one sheet comprising a plurality of predetermined fold lines configured to flex along the fold lines, each sheet being configured to be folded along at least a portion of the fold lines into a folded state having at least one predetermined shape and predetermined volume; and a grid plate comprising a plurality of grid openings or wells in a grid pattern, each grid opening configured to collect [or retain] a medication unit having a predetermined size and/or shape; wherein the grid plate is configured to releasably couple with the container assembly for collecting medication; and wherein the medication is configured to be dispensed from within the handle assembly.

The cost of transporting counting devices is often related to volume, and may be significant. To this end, the ability to ship more devices in the same shipping space can provide a significant improvement in shipping cost. In various aspects, the present devices may advantageously make more efficient use of shipping space by including the ability to collapse in a predetermined manner when in an unfolded state and fold into a substantially rigid folded state when ready to be used for counting. In further aspects, the container assembly may be configured to have a collapsed state and a folded state. In still further aspects, when the container assembly is configured in the collapsed state, the container assembly may have a substantially planar shape. In yet further aspects, when the container assembly is configured in the collapsed state, the container assembly may be completely flat or planar.

This collapsibility may allow devices to be shipped in the same amount of space than traditional non-collapsible counting devices. Devices of the present disclosure may be configured to be folded and/or assembled, in some aspects, by including folding patterns that may include one or more folds in the collapsible assemblies and/or assembly portions. Embodiments of the present disclosure that include fold lines or fold patterns, in contrast to traditional counting devices, may unfold into a substantially flat shape that can allow easier distribution as well as allows for more collapsed devices to be shipped than traditional non-collapsible devices in the same amount of space. The disclosed figures depict the substantial space-saving advantages of exemplary embodiments of the present disclosure.

In various aspects, the disclosed devices comprise at least one collapsible container assembly. In some aspects, one or more portions of the container assembly may be configured to fold into one or more of a handle portion, body (or base) portion, and trap door portion. In other aspects, the container assembly may comprise separate collapsible handle assemblies and collapsible body (or base) assemblies that are each configured to be folded into a predetermined shape and then coupled to one another to assemble the container assembly, as further described herein. In further aspects, each of disclosed collapsible assemblies may comprise a sheet comprising a plurality of predetermined fold lines configured to flex along the fold lines. In yet further aspects, each sheet may be configured to be folded along at least a portion of the fold lines into a folded state having at least one predetermined shape and predetermined volume. In even further aspects, at least a portion of the fold lines may define a plurality of panels. In still further aspects, the fold lines may define each of the plurality of panels. In even further aspects, the fold lines may define at one edge of the panels. In yet further aspects, the fold lines may comprise a living hinge, flexure, or the like. In even further aspects, the living hinges may be created by using any desired technique for producing living hinges, such as using laser cuts, for example, as evenly spaced lacer cuts along the fold lines.

In further aspects, the device may comprise a least one connecting means configured to releasably maintain a least a portion of an assembly or device component in a folded state or shape. In still further aspects, the connecting means can be configured to assemble various device components and/or couple device components together. In yet further aspects, the device may comprise a plurality of different or similar connecting means configured to perform various function. In some aspects, the device may comprise a plurality of connecting means configured to releasably maintain a least a portion of an assembly in a predetermined shape. In other aspects, the device may comprise a plurality of connecting means configured to releasably couple a portion of assembly to another device component and/or assembly portion. In further aspects, the connecting means may be configured to connect at one or more connection points. In still further aspects, the connection point may comprise an aperture or opening for attaching a connecting means. In yet further aspects, one or more connection points may have one or more corresponding connection points, wherein the corresponding connection points are configured to be connected using a shared connecting means.

In various aspects, the disclosed predetermined shapes comprise three-dimensional polygons or polyhedrons. In further aspects, the predetermined shape may comprise at least one hexahedron shape or cube shape, or a combination thereof. In even further aspects, the predetermined shape may comprise a substantially square shape or substantially rectangular shape, or a combination thereof.

In further aspects, a container assembly may comprise a body portion, handle portion, or trap door portion or a combination thereof. In yet further aspects, the container assembly in the folded state comprises a body (or base) portion and a handle portion. In even further aspects, a portion of the container assembly may be configured to be folded into a handle portion. In still further aspects, a portion of the container assembly may be configured to be folded into a body portion. In some aspects, a first portion of the container assembly may be configured to be folded into a handle portion, second portion of the container assembly may be configured to be folded into a body portion, and/or a third portion of the container assembly may be configured to be folded into a trap door portion. In other aspects, the container assembly comprises a separate handle assembly and body assembly.

In further aspects, the container assembly in an assembled state can comprise a body assembly coupled to a handle assembly. In still further aspects, the handle assembly can comprise a handle portion and/or a trap door portion. In yet further aspects, a proximal portion of the handle assembly may be configured to be folded into a first handle portion and distal portion of the handle assembly may be configured to be folded into a second handle portion. In even further aspects, at least one portion of the handle assembly may be configured to be folded into a trap door portion in communication with a channel in the handle portion. In still further aspects, the trap door portion may be connected to a middle portion of the handle portion. Thus, in some aspects, a first portion of the handle assembly may be configured to be folded into a handle portion comprising a channel, and second portion of the handle assembly may be configured to be folded into a trap door portion in operable communication with the channel. To this end, the trap door portion is configured to open into, or otherwise provide access to the channel of the handle portion. Thus, the handle assembly can be configured to dispense medication through the trap door portion into the channel and out the handle portion.

In various aspects, device and/or assembly segments can include a plurality of various panels. In further aspects, panels can comprise one more of wall panels, door panels, support panels, connection tabs, connection flaps, extension tabs, extension flaps, support tabs, and support flaps. The various tabs and/or flaps can, in some aspects, can be created using relief cuts into a panel or sheet portion, and/or by cutting one or more edges into a desired shape or contour. In still further aspects, the plurality of panels may be connected to one another, such as, for example by a living hinge. In yet further aspects, panels may be separate and/or configured to be attached to other panels using a connecting means. In some aspects, separate panels may be configured to be permanently attached to other panels, such as for example, using an FDA-sanctioned adhesive. In other aspects, separate panels may be detachably connected to other panels, such as for example, using a magnetic connector and/or snap fastener.

In further aspects, a handle portion of the device may comprise at least one of: back wall panel, side wall panel, bottom wall panel, upper wall panel, and top wall panel. In still further aspects, the handle portion may comprise a grip area configured to be held by a user during operation of the device. In yet further aspects, the handle portion may be folded into or otherwise comprise a channel configured to dispense medication from the handle portion. In further aspects, a body (or base) portion may comprise at least one of: back wall panel, side wall panel, front wall panel, and trap door panel. In still further aspects, a body (or base) assembly may comprise a back wall panel, a plurality of side wall panels, and a front wall panel. In yet further aspects, the trap door portion comprises one or more trap door panels. In even further aspects, each wall panel and/or door panel may be connected to or otherwise comprise one or more connection tabs, connection flaps, extension tabs, extension flaps, support tabs, and/or support flaps, as further described herein.

In various aspects, the disclosed device can comprise one or more replaceable grid plates having grid openings or wells configured to retain a medication unit. In further aspects, the grid plates can comprise a plurality of grip openings or wells configured in a grid opening pattern or arrangement. In some aspects, the device can further comprise a grid cover configured to cover at least a portion of the grid openings, for example, an outer counting surface of the grid plate. In still further aspects, the grid plate cover can be configured to change a grid opening pattern and/or number of accessible grid openings. To this end, the grid cover can allow a user to change pill quantity without changing grid plates.

In further aspects, the grid plate may comprise from greater than 0 to about 250 grid openings or wells. In still further aspects, the grid plate may be configured to collect from greater than 0 to about 250 units of medication. In yet further aspects, the grid plate may be configured to collect from greater than 0 to about 100 units of medication. In even further aspects, the grid plate may be configured to collect from greater than 0 to about 90 units of medication. In still further aspects, the grid plate may be configured to collect from greater than 0 to about 60 units of medication. In yet further aspects, the grid plate may be configured to collect from greater than 0 to about 30 units of medication. In even further aspects, the grid plate can be configured to retain any number of medication unit within the above exemplified ranges.

In yet further aspects, the grid plate may further comprise a grid plate coupling or mating portion configured for detachably securing the grid plate to the body portion or assembly. In still further aspects, a portion of the grid plate may be folded to provide the grid plate coupling portion. In yet further aspects, the grid plate coupling portion may be separately attached to a surface of the grid plate. In even further aspects, the grid plate coupling portion may comprise or otherwise take the form of a connection flap or tab. In even further aspects, the grid coupling or mating portion may be configured to couple the grid plate such that at least a portion of the bottom surfaces of the grid plate and top edges of the container assembly are in contact.

In various aspects, the device may comprise a closed position and an open position. In further aspects, the closed position may comprise when the trap door portion is flush against an underside of the grid plate such that medication cannot fall through a grid opening. In still further aspects, the closed position may comprise when at least one trap door panel is flush against an underside of the grid plate such that medication cannot fall through a grid opening. In yet further aspects, the open position may comprise when the trap door portion is sufficiently separated from an underside of the grid plate such that medication can fall from within or through a grid opening. In even further aspects, the open position may comprise when at least one trap door panel is separated from an underside of the grid plate such that medication can fall from within or through a grid opening.

In various aspects, the device components may be comprised of any pharmaceutically-compatible material, such as, for example, a thermoplastic material, laminated cardboard, or a combination thereof. In further aspects, the device and/or container assembly may comprise one or more polymers, including plastics, nylons, EVOH, polyolefins, or other natural or synthetic polymers. In still further aspects, the device and components may be manufactured using polyethylene terephthalate (PET), polyethylene naphthalate (PEN), poly (butylene 2,6-naphthalate) (PBN), polyethylene (PE), linear low-density polyethylene (LLDPE), low-density polyethylene (LDPE), medium-density polyethylene (MDPE), high-density polyethylene (HDPE), and/or polypropylene (PP). In yet further aspects, the material or materials selected and the thickness of that material or those materials may determine the rigidity of the device and/or container assembly. In further aspects, the container volume may comprise a volume in the range of from about 10 mL to about 1000 mL, including any volumes therebetween, including but not limited to 100, 200, 300, 400, 500, 600, 700, 800, and 900 mL.

In various aspects, medication and/or medication unit can comprise any desired medication or medication form. In further aspects, medication may comprise any solid dosage form. In still further aspects, the dosage form may comprise pills, tablets, capsules, caplets, suppositories, unit-dose medication, unit dose vials, or the like.

In various further aspects, the device and device components comprise a plurality of connecting means. In still further aspects, the connecting means can comprise a snap, button, clasp, clip, adapter, fitting, insert, pin, adhesive, brazing, soldering, welding, spot weld, fasteners, screw with nut, bolt with nut, rivet, threading, friction fit, snap-fit, twist-lock, tab, locking mechanism, clamp, ball and socket, magnet and magnetic metal, or a combination thereof. In some aspects, the connecting means comprise button or snap fasteners. In other aspects, the connecting means comprise magnets. In further aspects, the magnets may be strong enough to remain in contact with a corresponding magnetic element while the user shakes it to remove excess pills and while the device is a closed position. The magnets may be simultaneously weak enough to allow the user to disengage them and change the device between open and closed positions. In some aspects, the magnets may comprise standard or neodymium disks (e.g., rare earth magnets), and may range from 3 mm-4 mm by 1 mm-4 mm disks (diameter by thickness). Other types of magnets may be used if they are sufficiently strong enough, for example, magnets having a pulling force from about 0.1 lb to about 10 lb. In some aspects, the magnets used in the disclosed devices may not reach maximal pulling force because magnets and ferromagnetic metals are always separated by the single sheet plastic, and may comprise a 1/16-inch gap between magnets and metals.

In aspects, an exemplary counting device of present disclosure may comprise: one or more sheets comprised of multiple living hinges (e.g., 12-24 living hinges), which has 2 states or configurations: flat shape (i.e., unfolded or collapsed state) and three-dimensional polygon shape (i.e., folded or assembled state); and grid plate (various grid well shapes, sizes, quantities, and patterns); and optionally a pill bin. In further aspects, a device in the folded state may be used for counting pills, and comprises two positions, closed and open. In still further aspects, in the closed position—trap door portion is flush against grid plate such that pills cannot fall through grid wells, the handle portion height is at its highest level or point, and fasteners between trap door portion and pill grid are engaged. In yet further aspects, in the open position, handle portion height is at low enough point such that fasteners between trap door portion and pill grid are disengaged, the trap door portion is separated from the underside of the grid plate, and pills are free to fall from within or through their respective grid wells.

According to various aspects of the disclosure, the disclosed devices, apparatuses and systems can have a number of advantages over current solutions for counting medication and/or dispensing medication. In one aspect, Applicant's manual, (e.g., non-powered) semi-automatic device can ship completely flat and can be made from single sheets of material (plastic or cardboard or similar material). The flat state may be configured for cleaning, shipping, and/or storage. In some aspects, the device does not need to be flattened completely to clean. For example, the grid may be removed, and the inside may be accessed without collapsing or disengaging the container assembly. In other aspects, the present device can be made from single sheets of material which can reduce manufacturing costs, shipping costs and storage costs. For example, approximately 384 flattened devices could be stacked on top of each other and would roughly only be 2 feet tall, 1.5 feet wide, and 1 foot long. About 70 folded devices would fit in the same space.

In further aspects, the mechanism for dispensing the medication provides faster more accurate, and more efficient dispensing. For example, according to various embodiments of the present invention a pill may fall through the grid opening directly into a channel of the handle portion, and then dispensed out of the channel through a proximal handle portion opening without any potential complication. In other prior devices that employ "flips" using a hinged counting plate, one or more pills could remain lodged in an opening and could be flung into the air and/or tossed in an unfavorable manner when flipping the hinged plate back and forth. Further, the present devices do not require a user to pour out excess pills every single counting procedure. For example, prior devices often have integrated pill bins to catch excess pills, meaning excess pills remain in the integrated pill bins and must be funneled out of the device before continuing use. In the present device, excess pills passively fall of the counting surface of the grid plate, for example, into a pill bin or container below and when the user wants to, the user can pour the excess pills from the pill bin back into a stock bottle. The frequency of can be done once every 15 prescriptions of a 60-pill prescription. In prior devices, while preparing 15 prescriptions, the user would have to pour the excess pills back into the stock bottle 15 times.

The present disclosure, according to further aspects, also provides methods of using the disclosed devices and systems. In one aspect, disclosed herein is a method for dispensing medication to an end user, the method comprising: providing a disclosed counting device or system; providing at least one unit of medication; collecting the medication within at least one grid opening; and dispensing the medication by releasing the medication from the grid opening. The method may further comprise at least one of: coupling a grid plate to a portion of the container assembly, dispensing the medication from the container assembly via a handle portion, and delivering the medication to the end user. The medication may be dispensed into a prescription bottle prior to delivering to the end user. In further aspects, the disclosed counting devices and systems can be used for other counting and dispensing applications.

According to various further aspects of the invention, the counting devices, apparatuses, and systems can comprise multiple configurations. For example, various exemplary embodiments of the inventive counting devices and systems are shown in FIGS. 1A-10D.

FIGS. 1A-1D show various views and features of an exemplary device 100 for counting medication in accordance with the present disclosure. As shown, the counting device 100 comprises a collapsible container assembly 101 comprising a body portion 103 and handle portion 105; and a grid plate 107 coupled to the top of the body portion 103. Grid plate comprises a plurality of round grid openings, each grid opening configured to collect a round unit of medication. The container assembly and portions are shown in a folded, three-dimension state.

Figure 2:
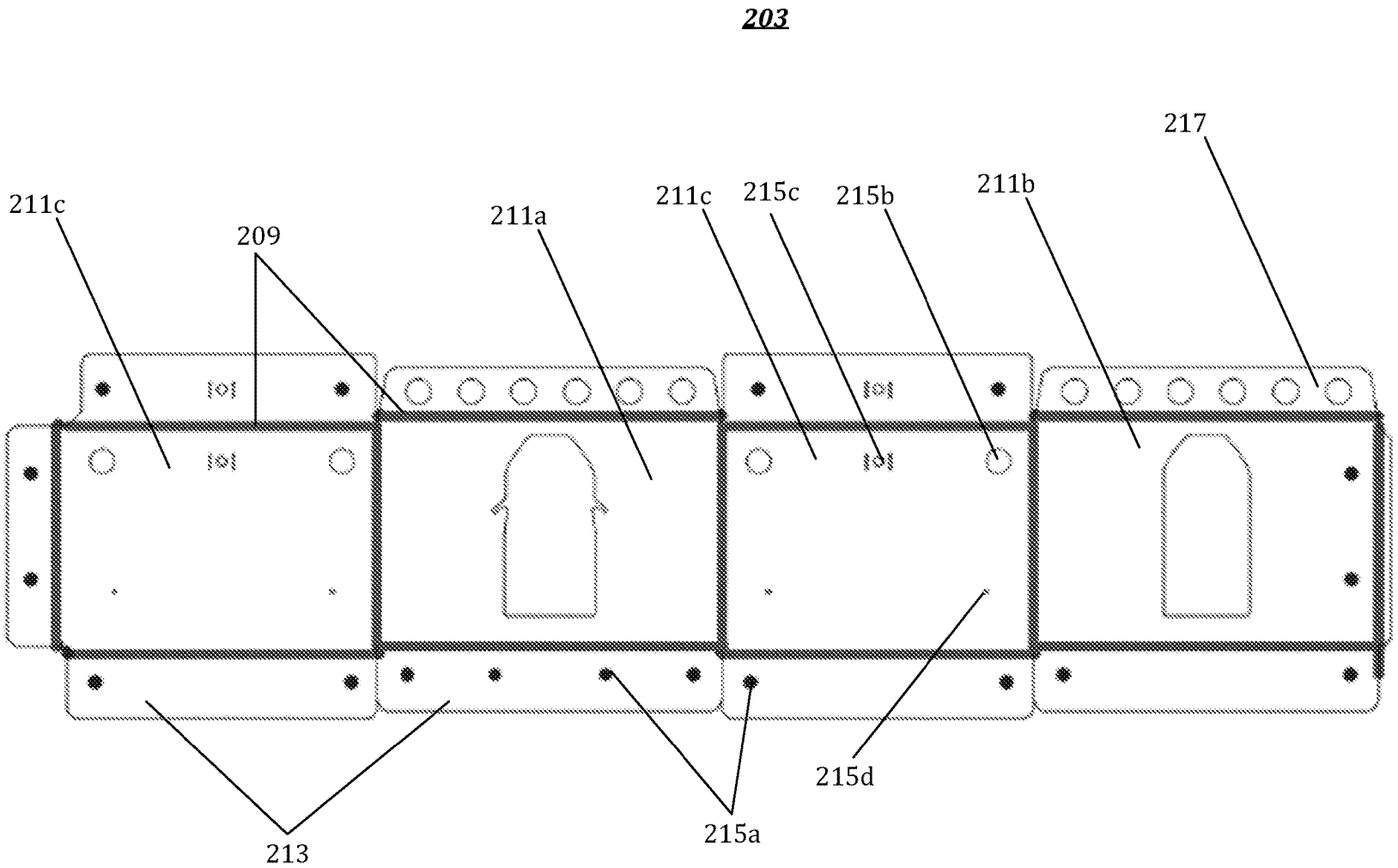
FIG. 2 shows a depiction of a box assembly for use in a disclosed counting device in accordance with an exemplary embodiment of the present invention.
Figure 3A:
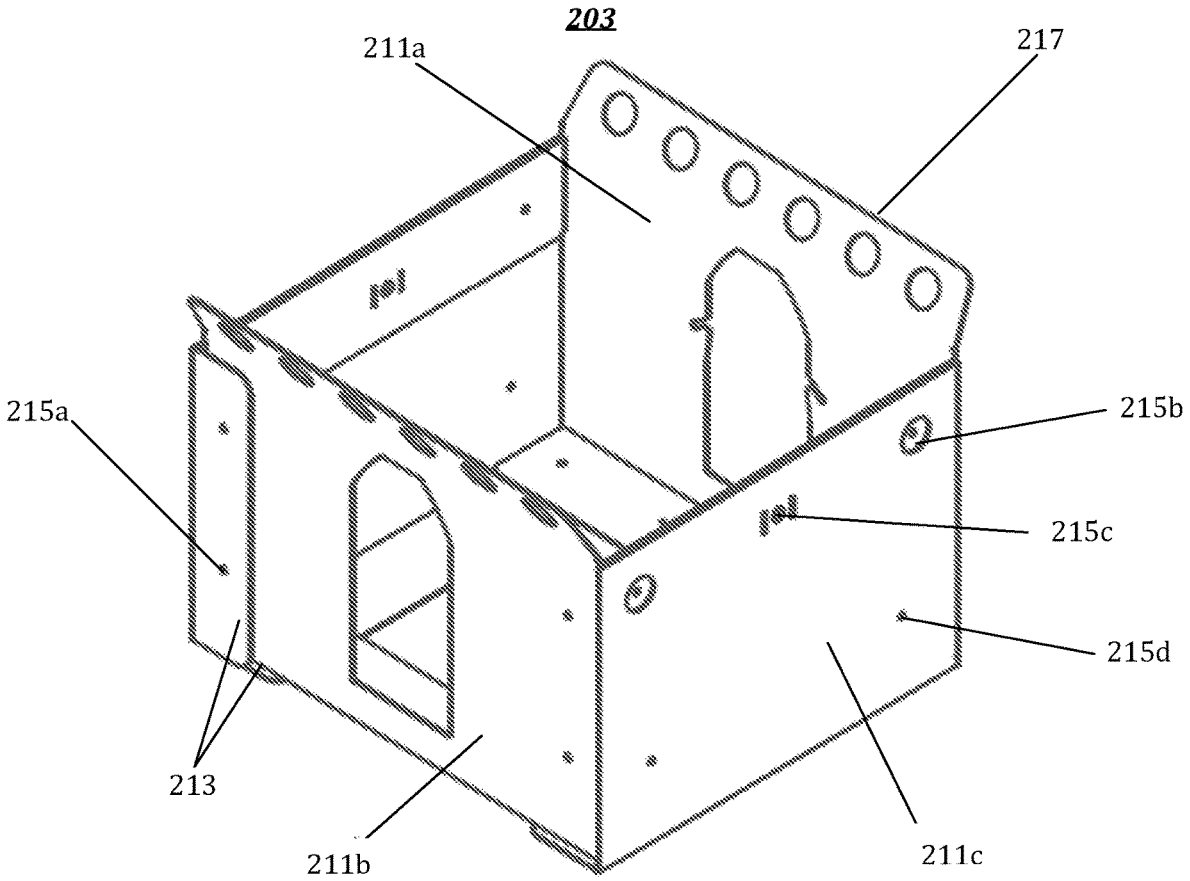
FIGS. 3A-3D shows depictions a box assembly for use in a disclosed counting device in accordance with an exemplary embodiment of the present invention.
Figure 3B:
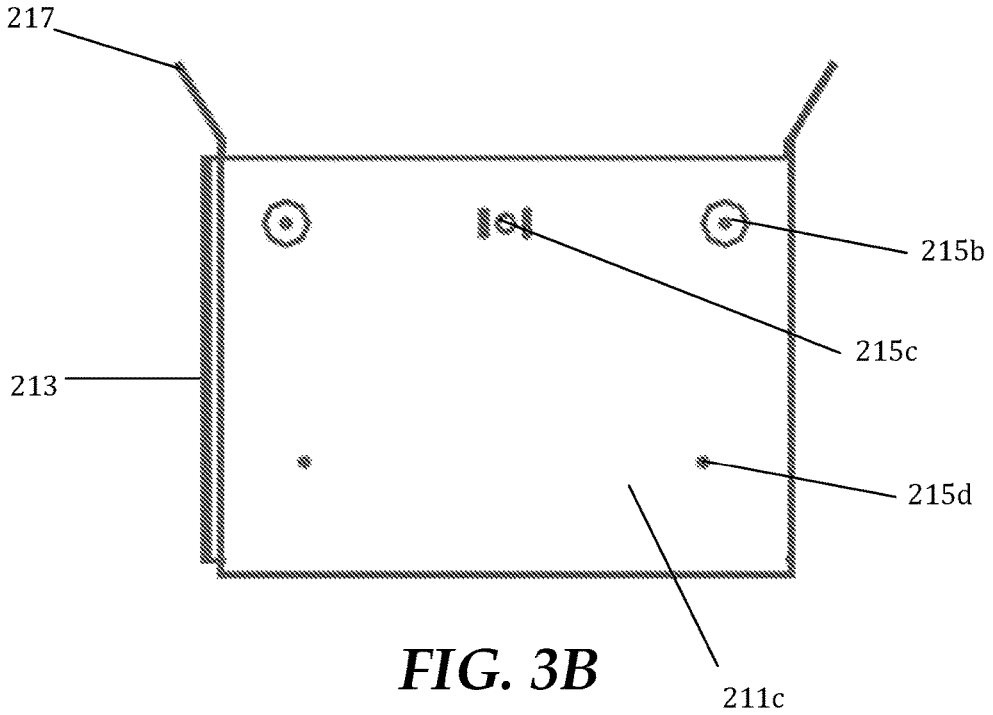
Figure 3C:
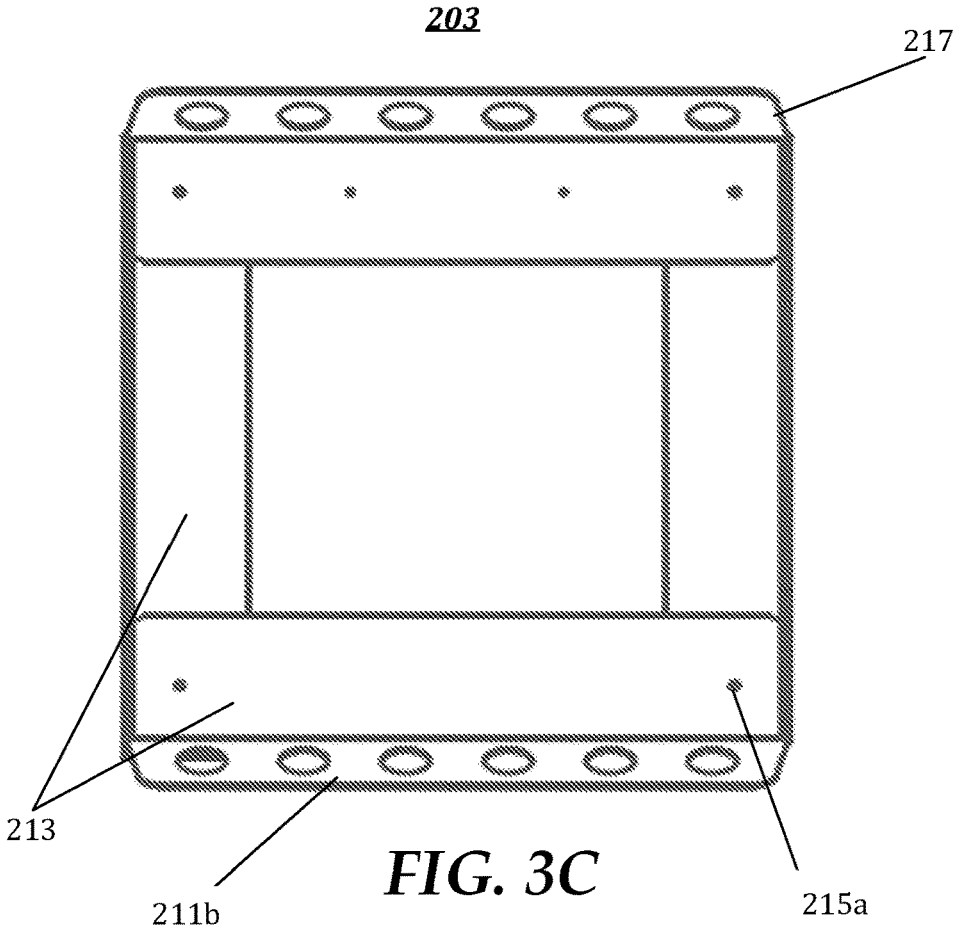
Figure 3D:
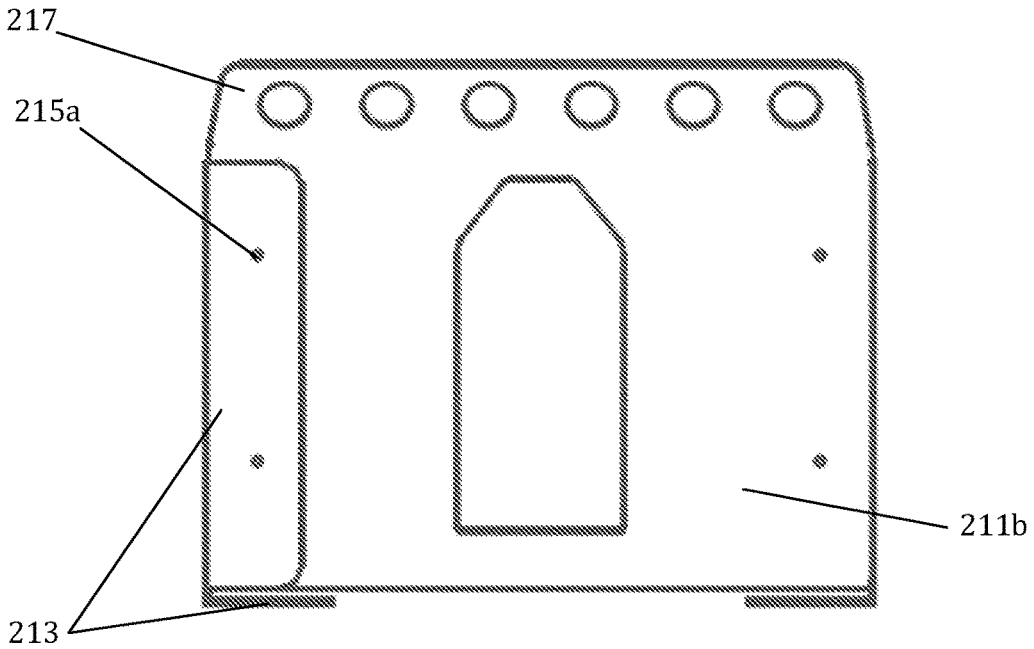

FIGS. 2-3D show various views and features of an exemplary body assembly 203 for use in the disclosed devices. FIG. 2 shows body assembly 203 as a flat, unfolded sheet comprising a plurality of panels connected by a plurality of fold lines 209. The sheet is configured to be folded along the fold lines 209 into cube shaped body as shown in FIGS. 3A-3D. Fold lines 209 define the plurality of panels and panel edges, which include front body wall panel 211*a*, rear body wall panel 211*b*, and side body wall panel 211*c*. The body assembly 203 further comprises a plurality of connection tabs 213 configured to fold against other panels and/or tabs to create the three-dimensional body assembly shape. Fasteners are configured to connect at connection points on the panels and tabs, such as at body connection points 215*a* to releasably maintain the body assembly and/or body portions in the predetermined shape. As shown in FIGS. 3C and 3D, connection tabs 213 connected to the bottom of body wall panels are folded at a 90-degree angle and connected to adjacent connection tabs, such as in the corners to increase rigidity. Likewise, connection tab 213 connected to the side edge of side body wall panels is folded at a 90-degree angle and connected to the surface of an adjacent body wall panel, such as rear body wall panel 211*b*. Fasteners may comprise detachable button or snap fasteners and/or magnets with correspondingly positioned ferromagnetic metals (e.g., metal that magnets are attracted to, such as iron, nickel, etc.) to allow the assembly to be quickly flattened or folded for use, but any suitable fastener may be used.

As shown in FIG. 3A, front body wall panel 211*a* and rear body wall panel 211*b* each comprise an opening or cut out for receiving a handle portion of the handle assembly. In further aspects, the bottom of the front and rear body wall panel openings may also act as a stopper for the handle portion from extending further down to prevent the user from slamming knuckles/hand onto surface each time the device is in the open position. Conversely, when the handle portion is at the top of the front and rear body walls openings, it can indicate to the user the device is in the closed position and pills can be poured on the grip plate. In some embodiments, the front panel front body wall panel 211*a* can comprise offset notches added to mate handle portion and/or trap door portion flush with the underside of the grid plate. As shown in FIG. 3B, side body wall panel 211*c* can comprise different connection points for connecting other device components, including trap door connection point 215*b*, grid plate connection point 215*c*, and tension element connection point 215*d*. Body portion and/or body wall panels may further comprise one or more extension tabs 217 that extend upward from the top of the body. The extension tabs 217 are configured to extend above the top surface of the grid plate and can increase time pills spend on grid surface since pills bounce off of extension tabs rather than falling off grid plate surface. Thus, it is believed that the extension tabs can enhance likelihood of pills falling into grid wells. Extension tabs 217 may also comprise connection points 215*e*, which are configured to allow for connecting other device components, such as a grid plate cover or grid plate guide cover as described herein. In some aspects, the extension tabs 217 may create a more optimal pill shaking environment for pills, so as to reduce re-pouring, such as in cases where grid openings do not all fill up after an initial pour. According to certain embodiments, the placement of the walls may also create a more ergonomic design because the user can simply turn their wrist to pour excess pills out the left and right side of the grid. To this end, when the "exit" for excess pills is in the front or back, the user may have to move wrists up and down, or extend or flex arm to pour pills out, and may put unnecessary strain on the wrist and arms.

Figure 4:
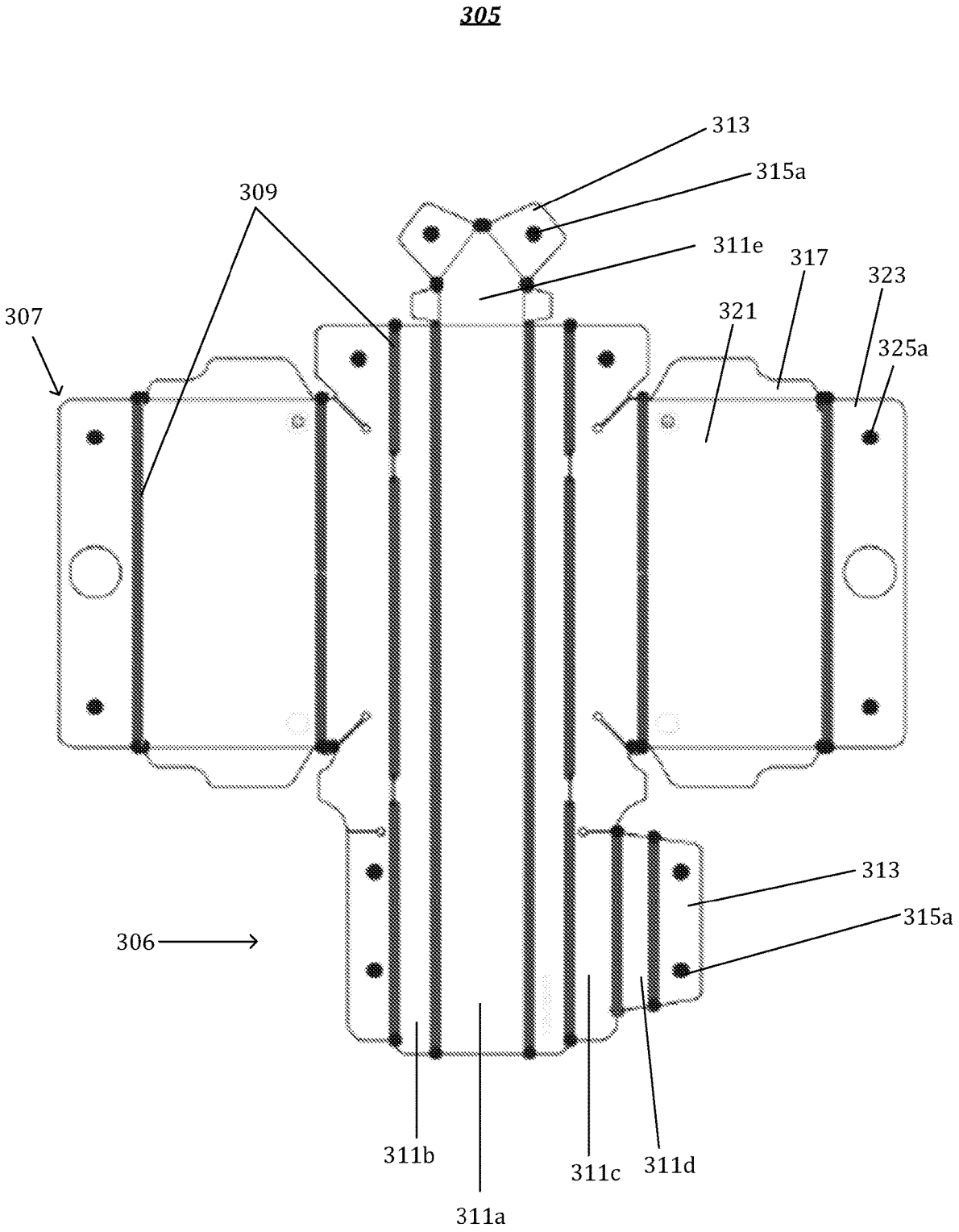
FIG. 4 shows a depiction of a handle assembly for use in a disclosed counting device in accordance with an exemplary embodiment of the present invention.
Figure 5A:
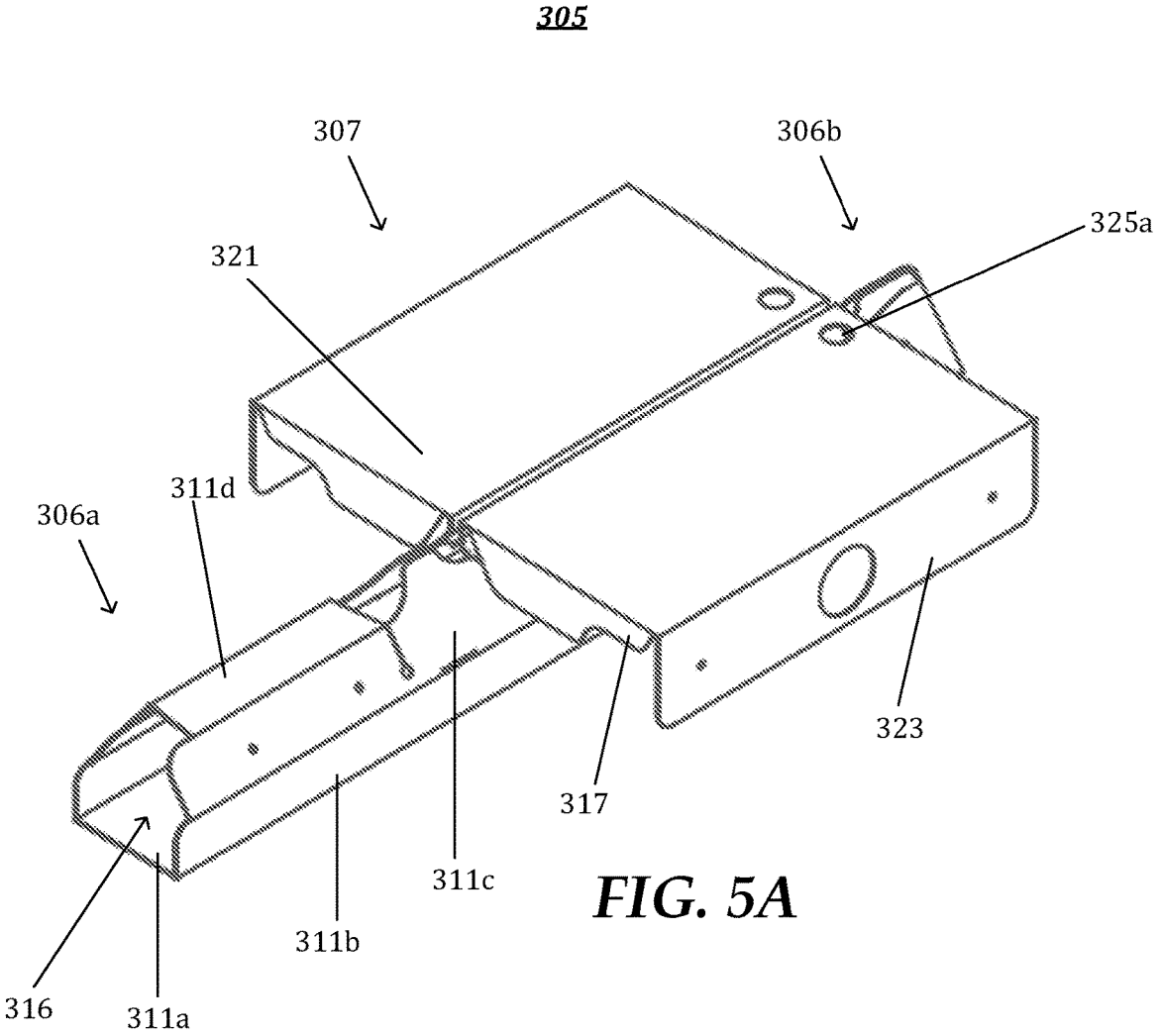
FIGS. 5A-5D show depictions of a handle assembly for use in a disclosed counting device in accordance with an exemplary embodiment of the present invention.
Figure 5B:
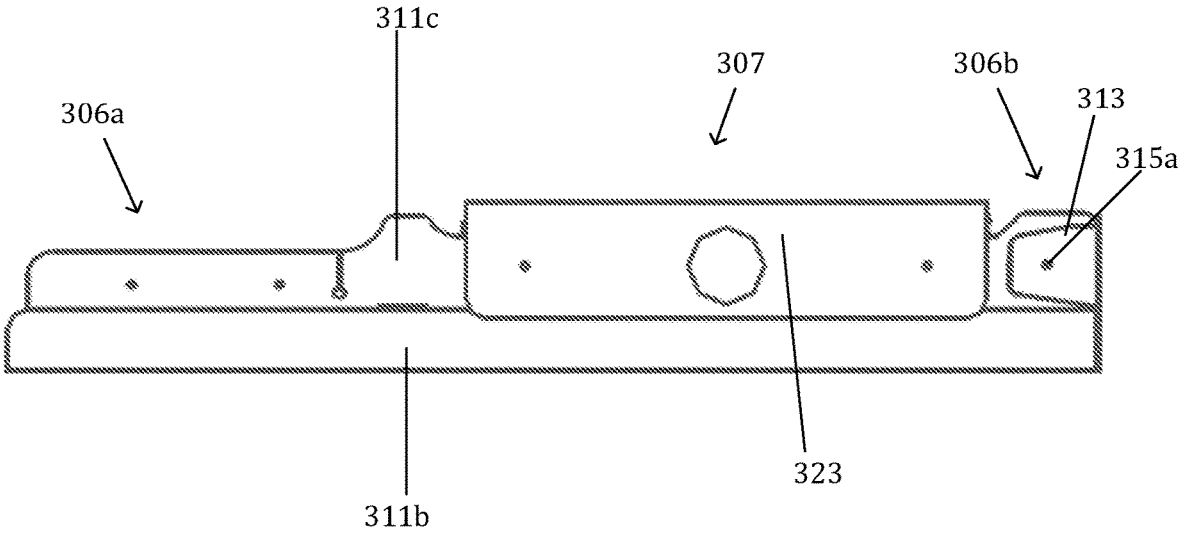
Figure 5C:
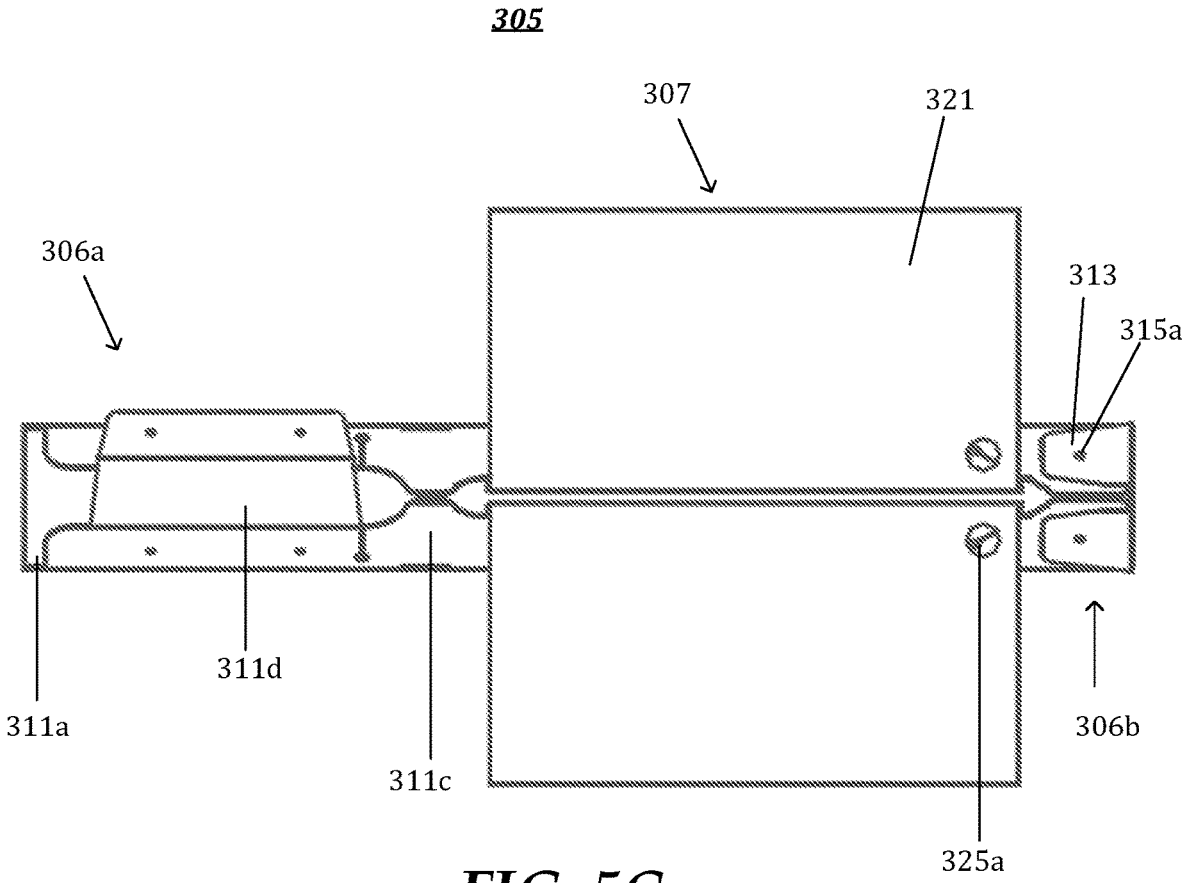
Figure 5D:
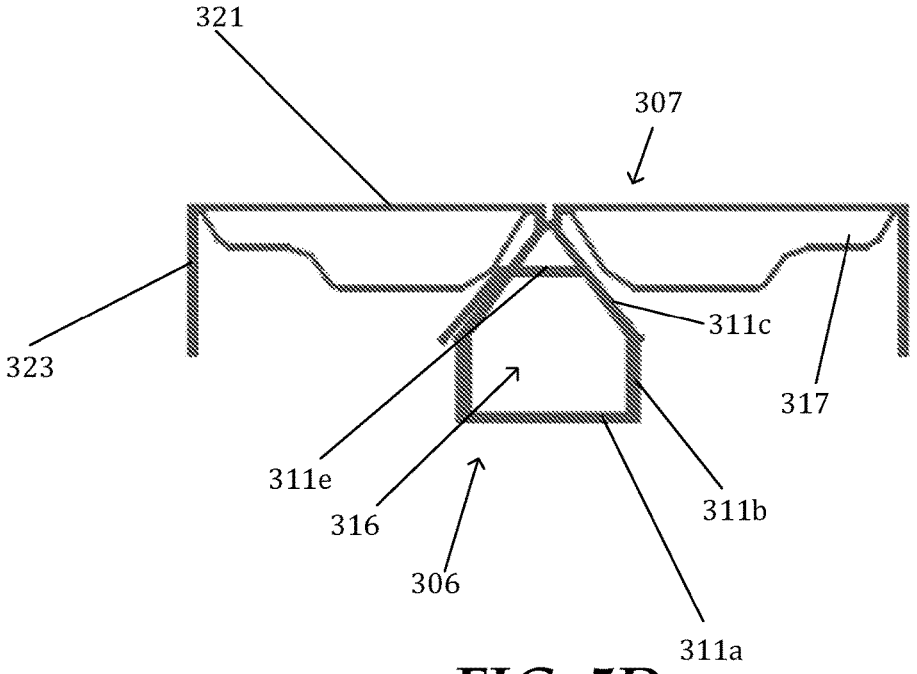
Figure 6A:
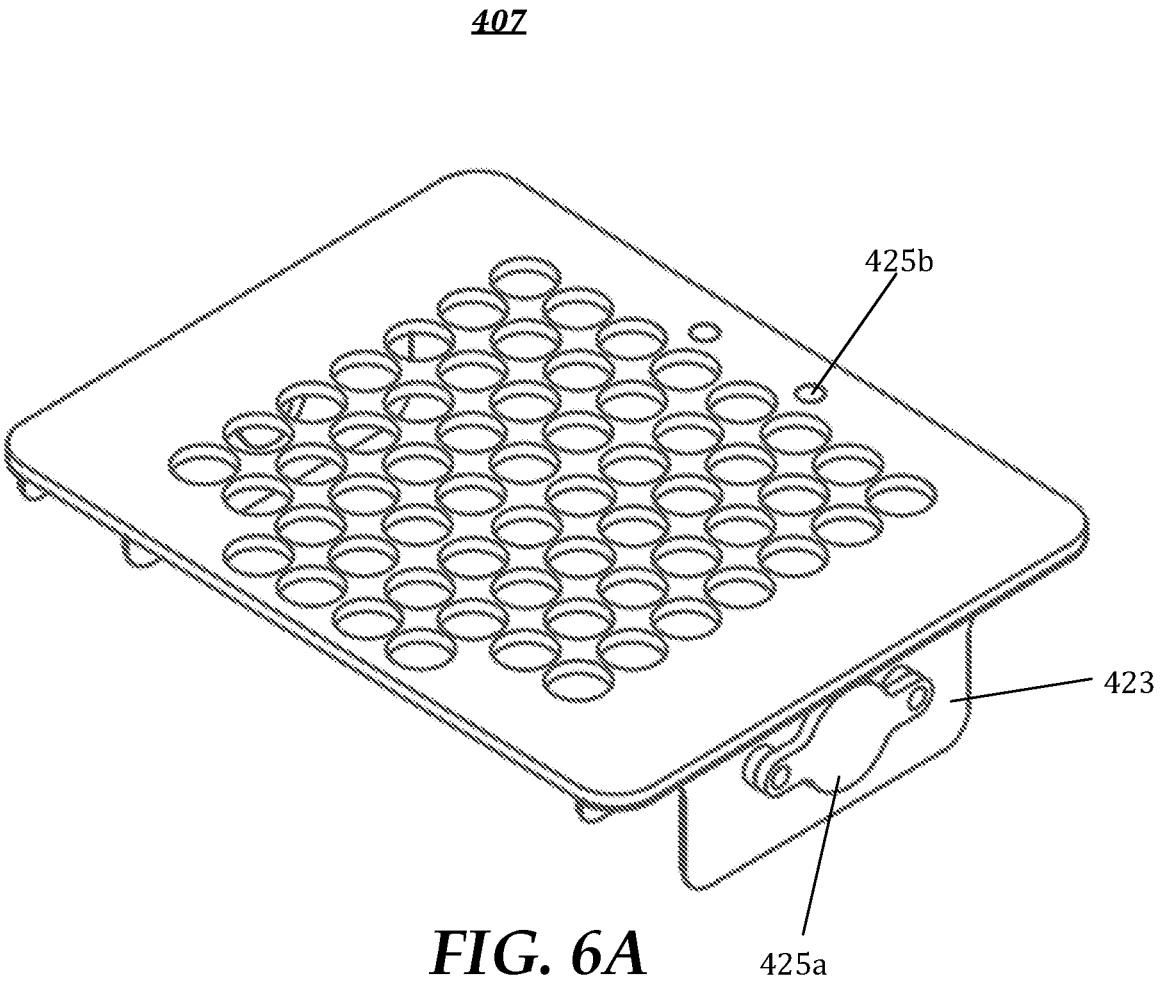
FIGS. 6A-6D shows depiction of grid plate for use in a disclosed counting device in accordance with an exemplary embodiment of the present invention.
Figure 6B:
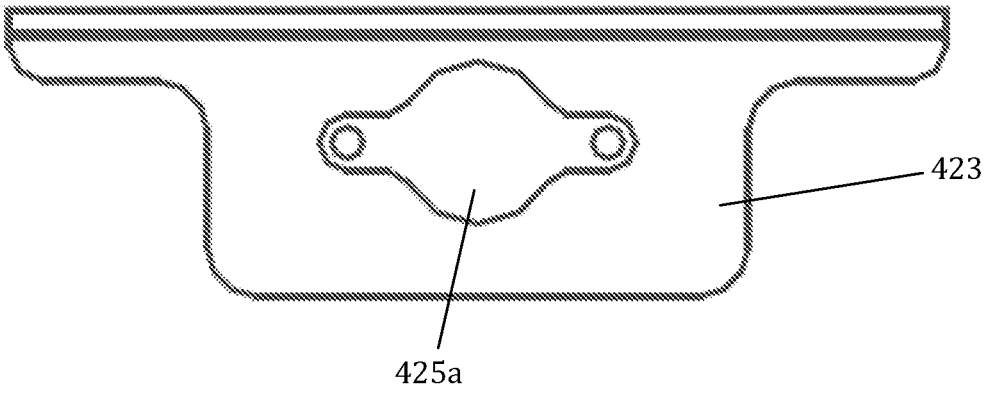
Figure 6C:
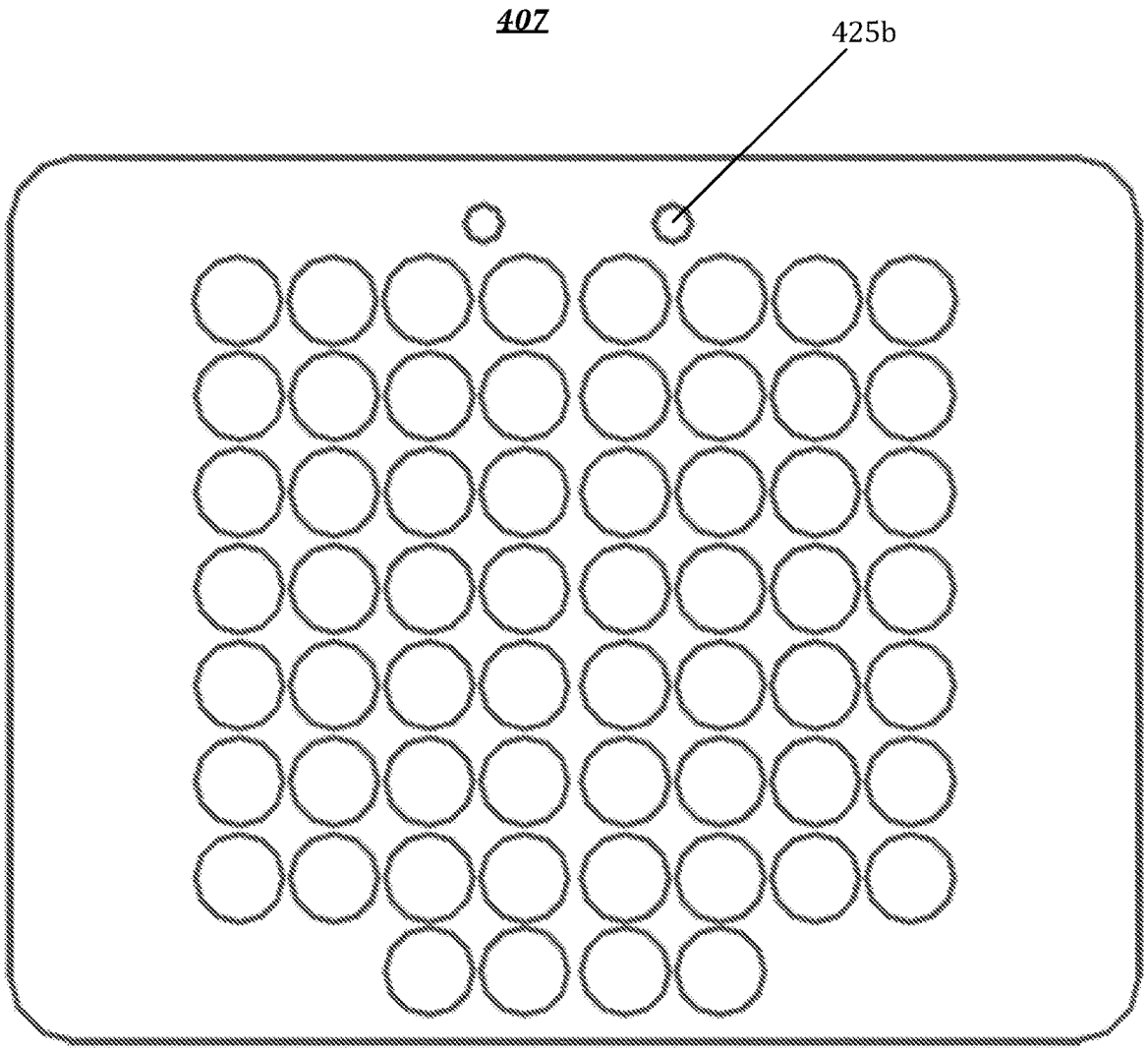
Figure 6D:
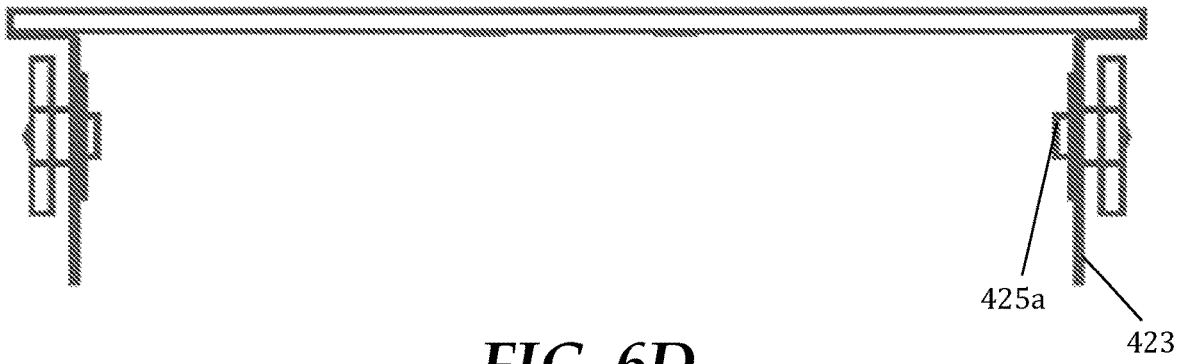

FIGS. 4-5D show various views and features of an exemplary handle assembly 305 for use in the disclosed devices. FIG. 4 shows handle assembly 305 as a flat, unfolded sheet comprising a plurality of panels connected by a plurality of fold lines 309 in the form of living hinges. The sheet is configured to be folded along the fold lines 309 into polygon shaped handle portions 306 and trap door portion 307 as shown in FIG. 4A. Fold lines 309 define the plurality of panels and panel edges, which include bottom handle wall panel 311*a*, side handle wall panels 311*b*, upper handle wall panels 311*c*, top handle wall panel 311*d*, and back handle wall panel 311*e*. The handle assembly 305 further comprises a plurality of connection tabs 313 configured to fold against other panels and/or tabs to create the three-dimensional body assembly shape. Fasteners are configured to connect at connection points on the panels and tabs, such as at handle connection points 315*a* to releasably maintain the handle assembly and/or handle portions in a predetermined shape comprising a channel 316. In the present embodiment, a proximal portion of the handle assembly 305 is configured to be folded into a first handle portion 306*a* and distal portion of the handle assembly is configured to be folded into a second handle portion 306*b*. Handle portions 306 are configured to extend through front body wall panel 211*a* and rear body wall panel 211*b* openings. Extending the handle portion through both body wall panels can increase the handle portion volume, and thus, number of pills which can be contained within the handle channel. First handle portion 306*a* comprises a top handle wall panel connected to the edge of upper handle wall panel, such that when folded, a gripping area is created for the user to hold. In handle portion area adjacent to the trap body portion, upper handle wall panels 311*c* meet at an angle, which can improve rigidity of handle and prevent handle from collapsing. The handle portion can allow the user to hold on to the device while it is being used, and to pour the counted pills into a prescription container, while the griping area is where the user puts their hand to hold the device and where pills are poured out of. Back handle wall panel 311*e* may prevent pills from falling outside of the back or distal end of the handle portion channel. In certain embodiments, the upper handle wall panel 311*c* and back handle wall panel 311*e* may increase rigidity, and help keep pills inside of the handle portion, and the bottom handle wall panel 311*a* keeps the pills inside of the handle portion and is where pills slide down when pills are poured of the handle portion. In further aspects, top handle wall panel 311*d* may be present to enhance hand comfort while holding device and/or prevent excess pills or contaminants from outside of the device from reaching the inside of the handle portion during use.

Connection tabs 313 connected to the edges of panels can be folded at appropriate angles and connected to adjacent connection tabs and/or surface of an adjacent handle wall panel, such as side handle wall panels 311*b*. In further aspects, a middle portion of the handle assembly is configured to be folded into a trap door portion 307, which is communication with the handle channel 316 such that the trap door portion can open into or otherwise provide access to the channel. Trap door portion 307 comprises two trap door panels 321, two trap door connection tabs 323 configured to connect with corresponding connection points on the body wall panel, and two trap door extension tabs 317 configured to be folded at 90-degree angle to increases strength of trap door panels. Trap door panels 321 further comprise connection point 325*a* for connecting to the underside of the grid plate. In further aspects, trap door portion 307 comprises a closed position and an open position, wherein the closed position is when at least one trap door panel is flush against an underside of the grid plate such that medication cannot fall through a grid opening, and the open position is when at least one trap door panel is separated from an underside of the grid plate such that medication can fall through a grid opening into channel. Fasteners, such as magnets, on trap door panels attach to the grid plate and depending on if these magnets are engaged can impact if the device is in the open or closed position.

FIGS. 6A-6D show various views and features of an exemplary grid plate 407 for use in the disclosed devices. Grip plate 407 comprises two grid connection tabs 423 configured to connect with corresponding connection points on the body wall panel at connection point 425*a*. Grid plate 407 includes fastener at connection point 425*a* for connecting to corresponding top surface of the trap door portion. Grid plates are configured to detachably secure to the body wall panel and trap door portion's corresponding fastener at connection point 325*a* with fasteners at connection point 425*b*. While magnets are used to allow the grid plate to be removed quickly and easily, other fasteners may be used. Grid plates can have a number of different configurations of grid opening quantities, shape, and pattern. For example, a country like Swaziland may need about 5-10 different grid opening configurations to cover the majority of bulk prescription counting. In other countries like America or even for disaster relief situations, different grid opening configurations and/or patterns could be made to fulfill the specific needs of that environment. To this end, the quantity, shape, and size of grid openings may vary. In some embodiments, the grid plate surface may comprise a wall or elevated surface directly along the grid openings. To this end, when shaking pills on the grid plate surface, a wall or elevated surface at the edges of the grid openings can facilitate or help guide pills into the grid openings. In still further aspects, an elevated surface help eliminate a large gap between the edge of grid openings and an outer edge of the grid plate and/or container assembly, for example, the area between a grid opening edge and body extension tabs on the distal and proximal sides of the device. In other aspects, the orientation of grid openings (e.g., oblong openings) may be consistent to allow the corresponding pill shape type to discharge from the pill grid more effectively. For example, an oblong/oval grid well can be long-ways parallel such that excess pills exit parallel to the grid opening. Orientation of the oblong/oval grid well may affect how quickly oblong/oval pills fill the well holes, how quickly excess oval/oblong pills exit the grid when shaken, and important in how many oblong/oval pills need to be poured or poured again on top of the grid plate.

Figure 7A:
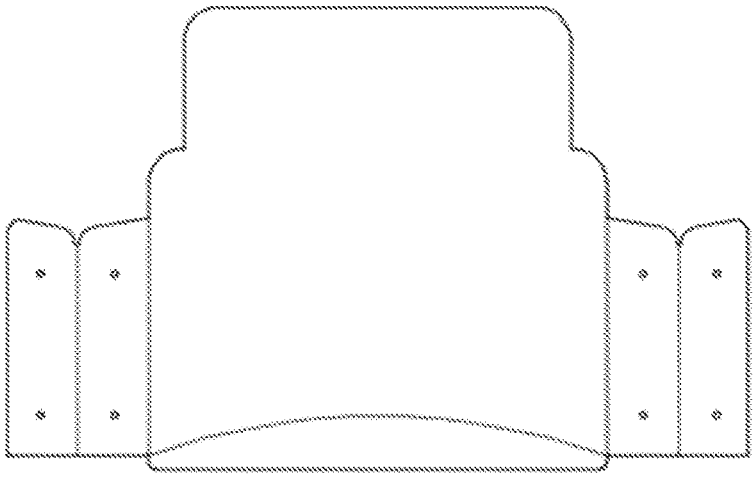
FIGS. 7A-7D show depiction of grip plate covers for use with the disclosed counting devices in accordance with an exemplary embodiment of the present invention.
Figure 7B:
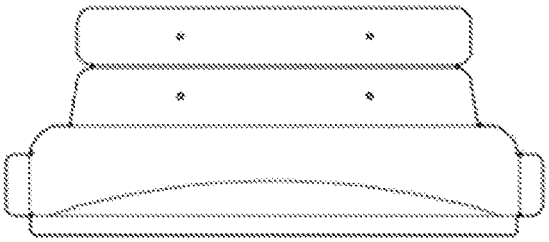
Figure 7C:
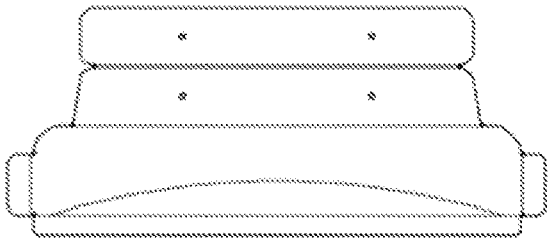
Figure 7D:
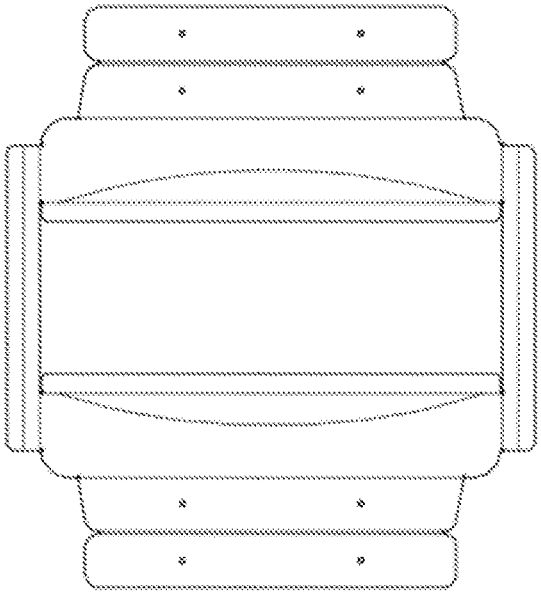
Figure 8:
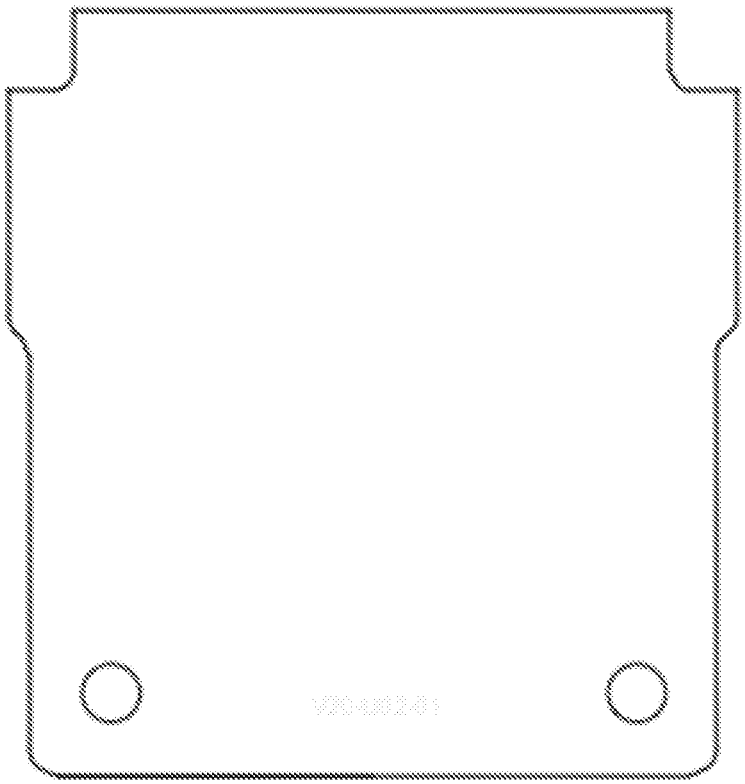
FIG. 8 shows a depiction of a tension element for use with the disclosed counting devices in accordance with an exemplary embodiment of the present invention.
Figure 9A:
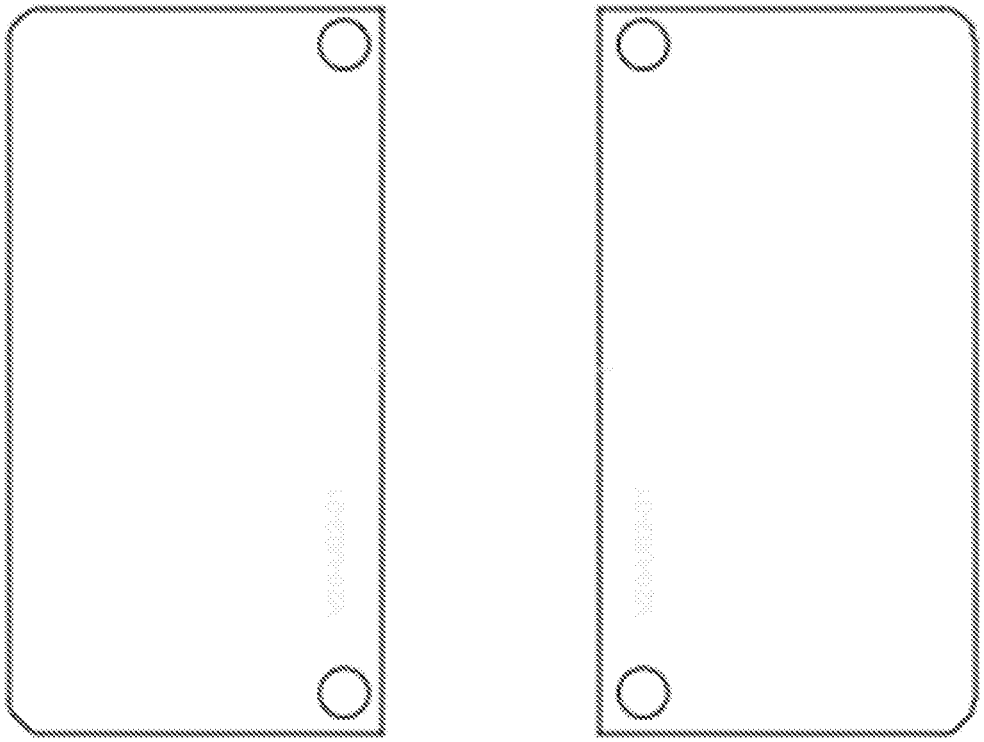
FIGS. 9A-9B show depictions of support panels for use with a counting device in accordance with an exemplary embodiment of the present invention.
Figure 9B:
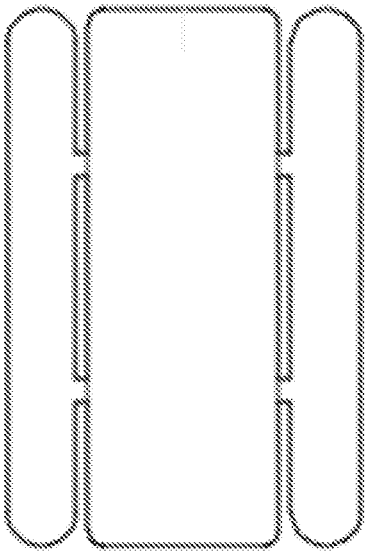
Figure 10A:
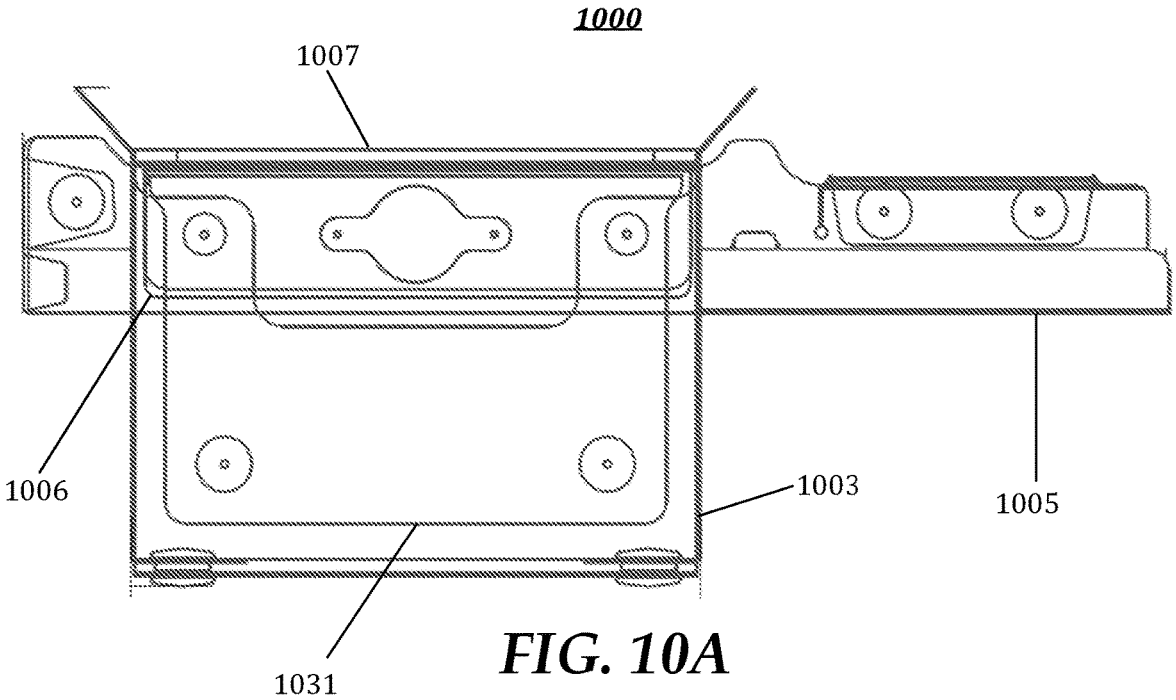
FIGS. 10A-10D shows depiction of a counting device in accordance with an exemplary embodiment of the present invention.
Figure 10B:
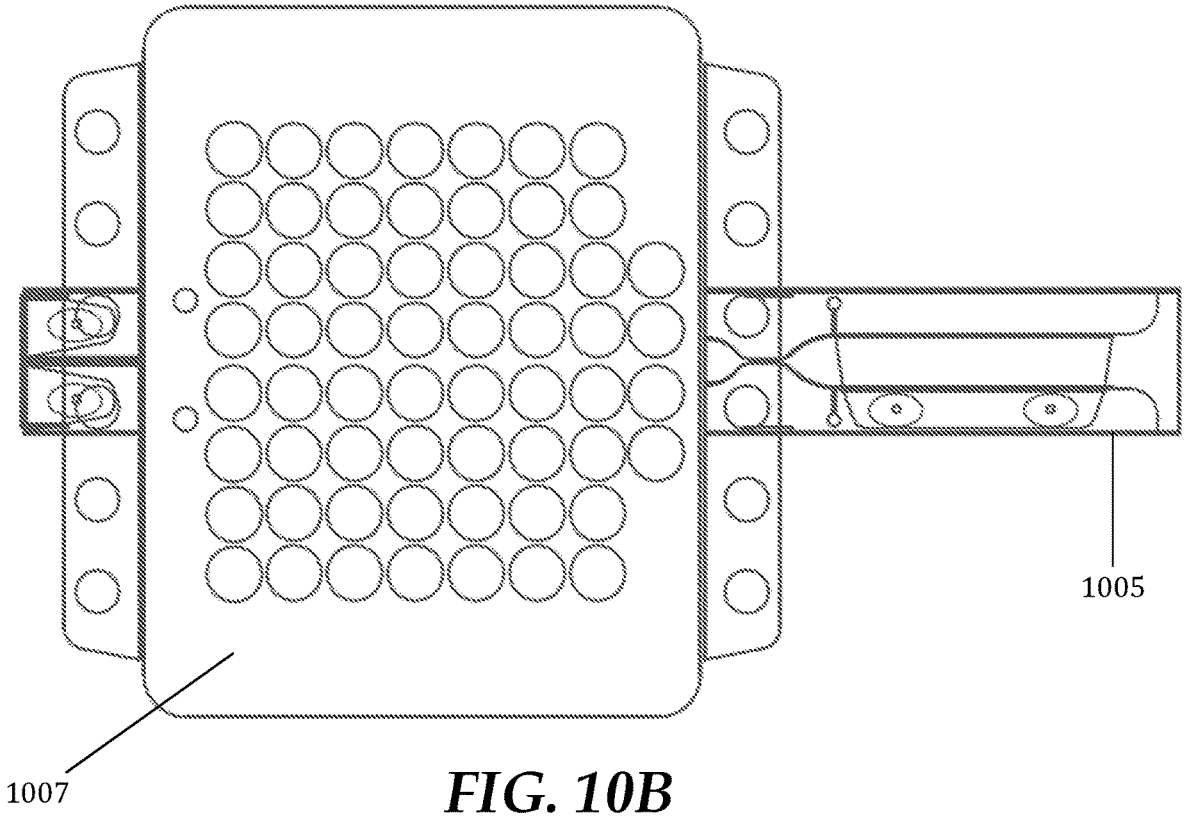
Figure 10C:
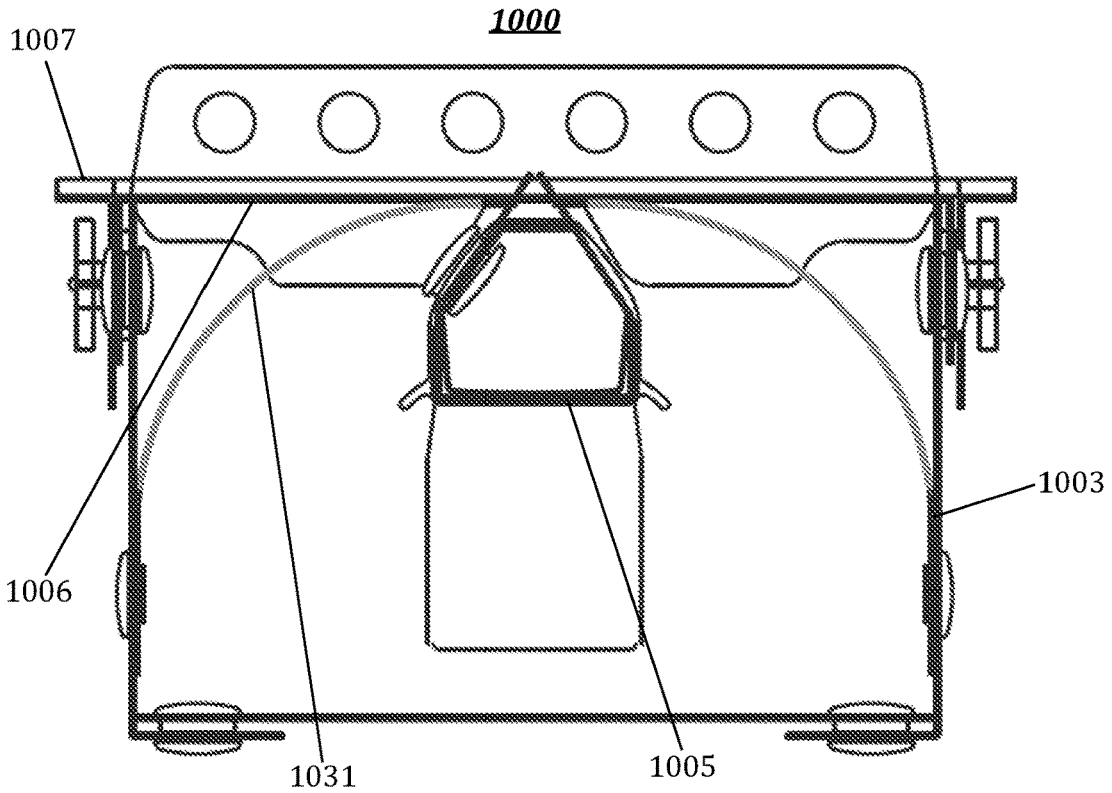
Figure 10D:
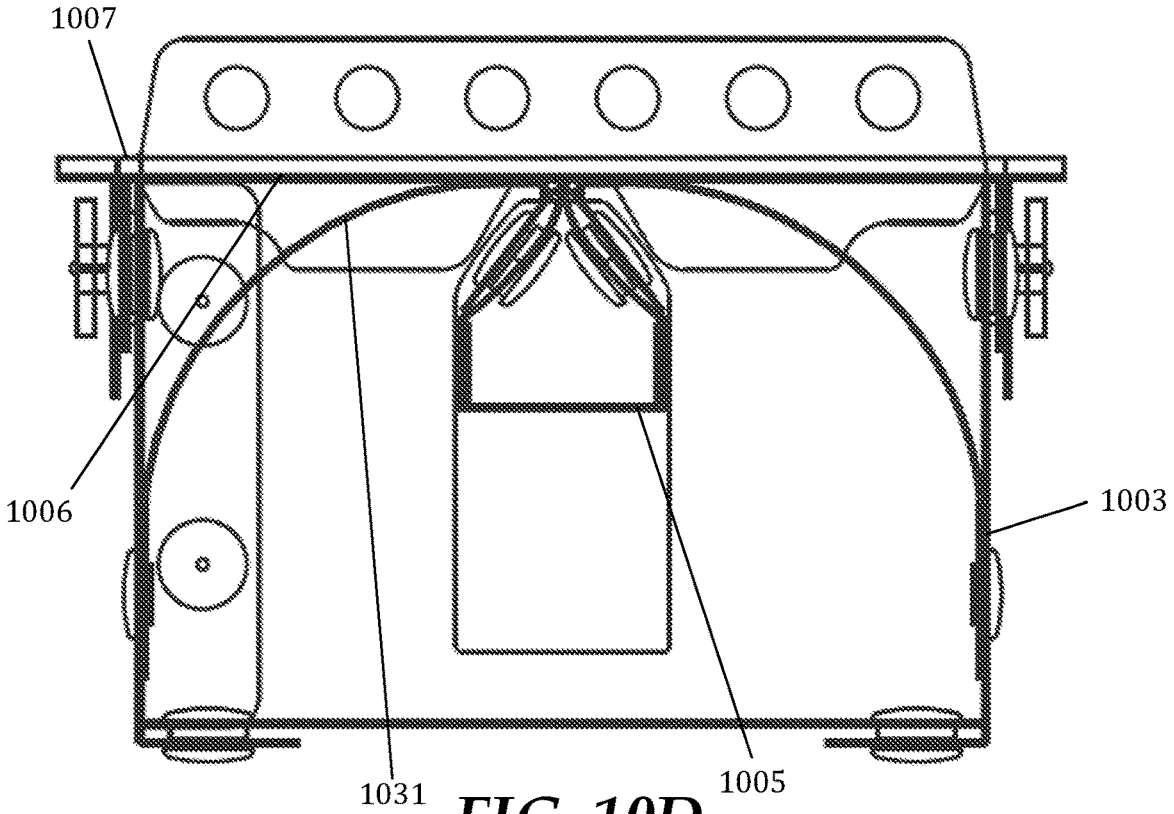

FIGS. 7A-9B show various view of additional components that may be used in connection with the disclosed devices and assemblies. In some embodiments, the invention may further comprise a grid plate cover configured to cover a portion of the grid openings to allow for creating a multiple grid opening configurations. The grid plate cover can be configured to change the grid pattern or number of accessible grid openings, and/or creating a guide for directing pills into grip openings. FIGS. 7A-7D show exemplary grid plate covers for use with the disclosed devices and grid plates. In further aspects, a grid plate cover can comprise a grid cover panel and one or more grid plate cover connection tabs. Grid cover panel can vary in size and shape, and are configured to cover a portion of an outer surface of the grid plate. Grid plate cover connection tabs are configured to connect to a portion of the body assembly and/or body portion, for example, at one or more grid cover connection points on body extension tabs. In some aspects, such as shown in FIG. 7A, a grid plate cover can comprise a grid plate cover panel configured to change the grid pattern by covering a portion of the number of accessible grid openings. In other aspects, such as shown in FIGS. 7B-7D, a grid plate cover panel can be configured to assist in guiding pills into grid openings. In further aspects, a grid plate cover panel can comprise or otherwise provide a wall or elevated surface directly along the grid openings. To this end, when shaking pills on the grid plate surface, a wall or elevated surface at the edges of the grid openings can facilitate or help guide pills into the grid openings. In still further aspects, a grid plate cover can help eliminate a large gap between the edge of grid openings and an outer edge of the grid plate and/or container assembly, for example, the area between a grid opening edge and body extension tabs on the distal and proximal sides of the device. In even further aspects, the device can be configured such that a plurality of grid plate covers can be attached to the device. For example, one grid plate cover can be attached to cover a portion of the grid openings, and additional grid plate covers can also be attached to guide pills into the accessible grid openings. In other embodiments, the invention may further comprise a tension element or other means for exerting resistance or a vertical pressure against the trap door portion effective to maintain the trap door portion or trap door panels in a closed position, such as in the absence of an opposing force, for example, to provide resistance to when the handle portion is pressed down and/or retract the handle and trap door portion back to an upright or closed position. FIG. 8 shows an exemplary tension element in the form of a spring panel. One end of the spring panel is configured to attach to the body side wall panels at a tension element connection point, and an opposed end is configured to connect to or otherwise be in operable communication with handle and trap door portions, for example at a shared edge between a trap door panel and upper handle wall panel. In yet other embodiments, the invention may further comprise one or more support panels configured to attach to a corresponding panel surface to provide increased strength and support. FIGS. 9A-9B show exemplary support panels for use with the disclosed devices and grid plates. FIG. 9A shows trap door support panels configures to attach to trap door panels. FIG. 9B shows handle support panels configured to attach to bottom and side handle walls. The support panels can be attached to the corresponding panel surface using an adhesive, preferably an adhesive allowed by the FDA for use in medical devices.

In further aspects, FIGS. 10A-10D show various views and features of another exemplary device 1000 for counting medication in accordance with the present disclosure. As shown, the handle portion 1005, trap door portion 1006, and grid plate 1007 may interact in such a way that when a user holding onto the handle portion presses the entire device onto a surface, that the magnets between the trap door portion and the grid plate disengage, opening trap door panels and allowing pills held within the grid openings to fall freely into the handle portion. In further aspects, the synchronization between the living hinges in the trap door portion and handle portion, can allow the pills to fall into the handle portion channel once vertical pressure is applied from the user to the handle portion. While in the closed position, trap door panels and the grid plate may be securely flush by fasteners (e.g., magnets and ferromagnetic metals) between the trap door panels and grid plate. This fastening may ensure that these two parts are completely flush per the user's intention. When the user holds onto the handle portion's gripping area and presses vertically down onto a surface, the fastener coupling the trap door panels and grid plates is disengaged and the trap door panels no longer remain flush with the grid plate.

In further aspect, body portion 1003 may comprise spring panel 1031 attached to the body side wall panels, which can exert resistance or a vertical pressure against the trap door portion, for example a shared edge between a trap door panel and upper handle wall panel, to retract the handle portion and/or trap door portion back to the closed position. In the absence of the spring panel, fasteners between the trap door panels and grid plate may not automatically reengage. To this end, to reengage and create a flush surface once again, the user would need to lift the handle portion upward until the fasteners (e.g., magnets and metals) are again in close enough proximity that the force of the magnets overcomes the weight of the handle portion. In further aspects, there may be a "snapping" effect, which ensures that the device has been returned to a closed position and signals to the user that they can proceed counting pills and pour pills onto the grid plate.

When using the disclosed devices, pills for a prescription may be poured onto the counting surface of the removable grid plate until all of the grid opening or wells are filled with pills. To this end, the pills may be thus "counted" by visually confirming all grid wells are filled with pills without the need to actually numerically count the pills. Any excess pills remaining on the grid counting surface may be shaken off and onto a surface, shelf, pharmaceutical grade bin or container below the device. After the user confirms that each grid well is occupied by a pill, the user then presses the handle portion downward towards the surface that device is resting on, which disengages the trap door panels and creates a chute for the pills to fall from the grid wells into the channel of the handle portion. Next, the pills may then be poured out of the handle portion into any designated prescription container. In some aspects, the surface of the channel may be curved to ensure the pills are do not jam up or otherwise collect at the edges of the channel. The curved surface can assist in collection of the pill into a central portion of the channel for dispensing out the handle portion. In some aspects, the curved surface can be accomplished by attaching a separate insert with the channel. In further aspects, to fill each grid well, pills are poured onto the grid plate and the user gently moves or shakes the device and pours additional pills until each well hole is filled by one pill. While the user shakes the device, the trap door panels are in the closed position and flush with the underside of the grid plate. If the trap door panels are not flush, pills may move farther down into the grid wells or slide underneath the grid plate, which can result in "doubling up" in the grid wells and cause inaccuracies necessitating a recount.

For cleaning, the user may remove the magnetically attached grid plate and then flatten the entire device onto a surface, for example, by reaching under each wall panel and pull in opposing directions. By pulling each wall panel, the living hinges may orient themselves into a flat, 180-degree orientation. In some aspects, fasteners, such as magnets or snaps, may be used to maintain the shape so the fasteners can be disengaged and the device can be flattened out. In further aspects, the device may remain flat and allows it to be easily cleaned between uses. In alternative aspects, the grid plate can be removed, press down on the handle portion, and then clean inside the handle portion without flattening the entire device. To reassemble, the user may lift the device, grab hold of the handle portion and fasten the fasteners in any order to return the device to the usable shape. Then, the user may attach whichever grid plate they want to the device and continue to use the device.

The present invention includes at least the following aspects: Aspect 1: A device for counting medication, the device comprising: a collapsible container assembly, the assembly comprising: a sheet comprising a plurality of predetermined fold lines, the plurality of predetermined fold lines configured to flex along the fold lines; wherein at least a portion of the sheet is configured to be folded along at least a portion of the fold lines into at least one predetermined shape having a predetermined volume; wherein the container assembly in a folded state is configured to releasably couple a grid for collecting medication; and a grid comprising a plurality of openings, each opening configured to collect a unit of medication having a predetermined size and/or shape.

Aspect 2: A device for counting medication, the device comprising: a collapsible container assembly, the assembly comprising: a plurality of panels sheet, at least a portion of the panels connected by predetermined fold lines, the predetermined fold lines configured to flex along the fold lines; wherein at least a portion of the panels are configured to be folded along at least a portion of the fold lines into at least one predetermined shape having a predetermined volume; and wherein the container assembly in a folded state is configured to releasably couple a grid for collecting medication; and a grid comprising a plurality of openings, each opening configured to collect a unit of medication having a predetermined size and/or shape.

Aspect 3: A device for counting medication, the device comprising: a collapsible container assembly, the container assembly comprising: a collapsible body assembly and a collapsible handle assembly, wherein each of the body assembly and the handle assembly comprise at least one sheet comprising a plurality of predetermined fold lines configured to flex along the fold lines, each sheet being configured to be folded along at least a portion of the fold lines into a folded state having at least one predetermined shape and predetermined volume; and a grid plate comprising a plurality of grid openings or wells in a grid pattern, each grid opening configured to collect or retain a medication unit having a predetermined size and/or shape; wherein the grid plate is configured to releasably couple with [engage] the container assembly for collecting medication.

Aspect 4: A device for counting medication, the device comprising: a collapsible container assembly comprising at least one sheet comprising a plurality of panels, the plurality of panels connected by predetermined fold lines, the predetermined fold lines configured to flex along the fold lines; wherein at least a portion of the plurality of panels are configured to be folded along at least a portion of the fold lines into a folded state having at least one predetermined shape and predetermined volume; and a grid plate comprising a plurality of grid openings or wells, each grid opening or well configured to retain a unit of medication having a predetermined size and/or shape; wherein the container assembly in a folded state is configured to releasably couple the grid plate for collecting medication.

Aspect 5: The device of any preceding aspect, wherein at least a portion of the fold lines define a plurality of panels.

Aspect 6: The device of any preceding aspect, wherein the plurality of fold lines defines a plurality of panels.

Aspect 7: The device of any preceding aspect, wherein the fold lines define each of the plurality of panels.

Aspect 8: The device of any preceding aspect, wherein the fold lines define at least one edge of at least one panel of the plurality of panels.

Aspect 9: The device of any preceding aspect, wherein the fold lines define a plurality of edges of at least one panel of the plurality of panels.

Aspect 10: The device of any preceding aspect, wherein the plurality of panels comprises at least one of wall panels, door panels, support panels, connection tabs or flaps, extension tabs or flaps, and support tabs or flaps.

Aspect 11: The device of any preceding aspect, wherein the container assembly is configured to have a collapsed state and a folded state.

Aspect 12: The device of any preceding aspect, wherein the container assembly is configured to have an assembled state.

Aspect 13: The device of any preceding aspect, wherein the body assembly and handle assembly are configured to have a collapsed state and a folded state.

Aspect 14: The device of any preceding aspect, wherein when the collapsed state has a substantially planar shape.

Aspect 15: The device of any preceding aspect, further comprising at least one connecting means configured to connect at one or more connection points to releasably maintain a least a portion of the container assembly in the folded state.

Aspect 16: The device of any preceding aspect, further comprising a plurality of connecting means configured to connect at a plurality of connection points to releasably maintain at least a portion of the container assembly in the folded state.

Aspect 17: The device of any preceding aspect, further comprising at least one connecting means configured to connect at one or more connection points to releasably maintain at least a portion of the container assembly in a predetermined shape.

Aspect 18: The device of any preceding aspect, further comprising a plurality of connecting means configured to connect at a plurality of connection points to releasably maintain at least a portion of the container assembly in a predetermined shape.

Aspect 19: The device of any preceding aspect, wherein the predetermined shape comprises a three-dimensional polygon or polyhedron.

Aspect 20: The device of any preceding aspect, wherein the predetermined shape comprises a hexahedron shape or cube shape, or a combination thereof.

Aspect 21: The device of any preceding aspect, wherein the container assembly in the assembled state comprises a body assembly coupled to a handle assembly.

Aspect 22: The device of any preceding aspect, wherein the handle assembly in the folded state comprises a handle portion and a trap door portion.

Aspect 23: The device of any preceding aspect, wherein a portion of the handle assembly is configured to be folded into at least one handle portion comprising a channel.

Aspect 24: The device of any preceding aspect, wherein a proximal portion of the handle assembly is configured to be folded into a first handle portion and distal portion of the handle assembly is configured to be folded into a second handle portion.

Aspect 25: The device of any preceding aspect, wherein at least one portion of the handle assembly is configured to be folded into a trap door portion in communication with the handle channel.

Aspect 26: The device of any preceding aspect, wherein the trap door portion in connected to a middle portion of the handle portion.

Aspect 27: The device of any preceding aspect, wherein a first portion of the handle assembly is configured to be folded into a handle portion comprising a channel, and second portion of the handle assembly is configured to be folded into a trap door portion in operable communication with the channel.

Aspect 28: The device of any preceding aspect, wherein the handle portion comprises at least one of a bottom wall panel, side wall panel, upper wall panel, top wall panel, and back wall panel.

Aspect 29: The device of any preceding aspect, wherein the handle portion comprises a plurality of wall panels selected from at least one of a bottom wall panel, side wall panel, upper wall panel, top wall panel, and back wall panel.

Aspect 30: The device of any preceding aspect, wherein the handle portion comprises a grip area configured to be held by a user during operation of the device.

Aspect 31: The device of any preceding aspect, wherein the handle assembly is configured to dispense medication through the trap door portion into the channel and out the handle portion.

Aspect 32: The device of any preceding aspect, wherein the body portion comprises at least one of: back wall panel, side wall panel, and front wall panel.

Aspect 33: The device of any preceding aspect, wherein the body assembly comprises at least one back wall panel, a plurality of side wall panels, and at least one front wall panel.

Aspect 34: The device of any preceding aspect, the body portion comprises a grid plate connection point configured for detachably securing the grid plate to the base portion.

Aspect 35: The device of any preceding aspect, wherein trap door portion comprises at least one trap door panel, trap door connection tab, and trap door extension tab.

Aspect 36: The device of any preceding aspect, wherein the trap door portion comprises a closed position and an open position.

Aspect 37: The device of any preceding aspect, wherein the closed position is when at least one trap door panel is flush against an underside of the grid plate such that medication cannot fall through a grid opening.

Aspect 38: The device of any preceding aspect, wherein the open position is when at least one trap door panel is separated from an underside of the grid plate such that medication can fall through a grid opening.

Aspect 39: The device of any preceding aspect, further comprising a tension element configured to exert a vertical pressure against the trap door portion effective to maintain the trap door portion in a closed position in the absence of an opposing force.

Aspect 40: The device of any preceding aspect, wherein the tension element comprises a spring panel.

Aspect 41: The device of any preceding aspect, where one end of the spring panel is configured to attached to the body side wall panels at a tension element connection point, and an opposed end is configured to connect to an edge of a trap door panel.

Aspect 42: The device of any preceding aspect, wherein the fold lines comprise a living hinge, flexure, or the like.

Aspect 43: The device of any preceding aspect, wherein the grid plate is configured to be replaceable.

Aspect 44: The device of any preceding aspect, further comprising a grid cover configured to cover at least a portion of the grid openings.

Aspect 45: The device of any preceding aspect, wherein the grid plate cover is configured to change the grid pattern and/or number of accessible grid openings.

Aspect 46: The device of any preceding aspect, wherein the grid cover comprises a grid cover panel and plurality of grid cover connection tabs.

Aspect 47: The device of any preceding aspect, wherein the grid cover panel is configured to cover an outer counting surface of the grid plate;

Aspect 48: The device of any preceding aspect, wherein the plurality of grid cover connection tabs is configured to connect to a portion of the body assembly and/or body portion.

Aspect 49: The device of any preceding aspect, wherein the plurality of grid cover connection tabs is configured to connect to an extension tab of the body assembly and/or body portion.

Aspect 50: The device of any preceding aspect, wherein the plurality of grid cover connection tabs is configured to connect at one or more connection points on an extension tab of the body assembly and/or body portion.

Aspect 51: The device of any preceding aspect, wherein the grid plate is configured to collect from greater than 0 to about 250 units of medication.

Aspect 52: The device of any preceding aspect, wherein the grid plate is configured to collect from greater than 0 to about 100 units of medication.

Aspect 53: The device of any preceding aspect, wherein the grid plate is configured to collect from greater than 0 to about 90 units of medication.

Aspect 54: The device of any preceding aspect, wherein the grid plate is configured to collect from greater than 0 to about 60 units of medication.

Aspect 55: The device of any preceding aspect, wherein the grid plate is configured to collect from greater than 0 to about 30 units of medication.

Aspect 56: The device of any preceding aspect, wherein the connecting means comprises an adapter, snap, button, fitting, insert, pin, adhesive, brazing, soldering, welding, spot weld, fastener, screw with nut, bolt with nut, clasp, clip, rivet, threading, friction fit, snap-fit, twist-lock, tab, locking mechanism, clamp, magnet and magnetic metal, or a combination thereof.

Aspect 57: The device of any preceding aspect, wherein the container volume comprises from about 10 mL to about 1000 mL.

Aspect 58: The device of any preceding aspect, wherein the device is comprised of a pharmaceutical grade material.

Aspect 59: The device of any preceding aspect, wherein the device is comprised of a thermoplastic material, laminated cardboard, or a combination thereof.

Aspect 60: The device of any preceding aspect, wherein the container assembly comprise at least one of polyethylene terephthalate (PET), polyethylene naphthalate (PEN), poly (butylene 2,6-naphthalate) (PBN), polyethylene (PE), linear low-density polyethylene (LLDPE), low-density polyethylene (LDPE), medium-density polyethylene (MDPE), high-density polyethylene (HDPE), and polypropylene (PP). one or more polymers, including plastics, nylons, EVOH, polyolefins, or other natural or synthetic polymers.

Aspect 61: The device of any preceding aspect, wherein the device may be manufactured using polyethylene terephthalate (PET), polyethylene naphthalate (PEN), poly (butylene 2,6-naphthalate) (PBN), polyethylene (PE), linear low-density polyethylene (LLDPE), low-density polyethylene (LDPE), medium-density polyethylene (MDPE), high-density polyethylene (HDPE), and/or polypropylene (PP).

Aspect 62: The device of any preceding aspect, wherein the material or materials selected and the thickness of that material or those materials may determine the rigidity of the container.

Aspect 63: The device of any preceding aspect, further comprising at least one support panel configured to attach to a wall panel and/or door panel.

Aspect 64: The device of any preceding aspect, further comprising a handle support panel configured to attach to a surface of a handle wall panel.

Aspect 65: The device of any preceding aspect, further comprising a handle support panel configured to attach to a surface of a handle bottom wall panel and side wall panels.

Aspect 66: The device of any preceding aspect, further comprising a trap door support panel configured to attach to a surface of a trap door panel.

Aspect 67: The device of any preceding aspect, wherein the medication can comprise any solid dosage form.

Aspect 68: The device of any preceding aspect, wherein the dosage form can comprise pills, tablets, capsules, caplets, suppositories, unit-dose medication, unit dose vials, or the like.

Aspect 69: A method for dispensing medication, the method comprising: a) providing a counting device of any preceding aspect; b) providing at least one unit of medication; c) collecting the medication within at least one grid opening; and d) dispensing the medication by releasing the medication from the grid opening.

Aspect 70: The method any preceding aspect, wherein the counting device is configured to collect medication when at least one trap door panel is flush against an underside of the grid opening such that medication cannot fall through the grid opening.

Aspect 71: The method any preceding aspect, wherein the counting device is configured to release the medication from within the grid opening when at least one trap door panel is separated from an underside of the grid opening such that medication can fall from within the grid opening.

Aspect 72: The method any preceding aspect, wherein releasing the medication comprises releasing the medication into a channel form from a handle portion of the device.

Aspect 73: The method any preceding aspect, wherein dispensing the medication comprises dispensing the medication from within the channel out through an opening at the proximal end of the handle portion of the counting device.

Aspect 74: The method any preceding aspect, wherein the medication enters the handle portion at a distal end and exits from a proximal end.

While aspects of the present invention can be described and claimed in a particular statutory class, such as the system statutory class, this is for convenience only and one of skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present invention is not entitled to antedate such publication by virtue of prior invention. Further, the dates of publication provided herein can be different from the actual publication dates, which can require independent confirmation.

The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A device for counting medication, the device comprising:

a collapsible container assembly comprising a body portion, a handle portion, and a trap door portion, the container assembly comprising at least one sheet having a plurality of predetermined fold lines configured to flex along the fold lines, the at least one sheet being configured to be folded along at least a portion of the fold lines into a folded state having at least one predetermined shape and predetermined volume; and a grid plate comprising a plurality of grid openings in a grid pattern, each grid opening configured to collect a unit of medication unit, the grid plate being configured to releasably couple with the container assembly for collecting medication;

wherein the device is configured to collect medication within the grid opening when the trap door portion is flush against an underside of the grid plate such that medication cannot fall through the grid openings; and wherein the device is configured to release collected medication from within the grid opening when the trap door portion is separated from the underside of the grid plate such that collected medication can fall from within the grid opening.

2. The device of claim 1, wherein the handle portion comprises a channel, and wherein the device is configured to release collected medication from within the grid openings into the channel.

3. The device of claim 2, wherein the device is configured to dispense medication from within the channel out through an opening at an end of the handle portion.

4. The device of claim 3, wherein the plurality of fold lines defines a plurality of panels.

5. The device of claim 4, wherein the plurality of panels comprises at least one of wall panels, door panels, support panels, connection tabs, extension tabs, and support tabs.

6. The device of claim 5, wherein the container assembly is further configured to have a collapsed state having a planar shape.

7. The device of claim 6, further comprising a plurality of connecting means configured to connect at a plurality of connection points for releasably maintaining the container assembly in the folded state.

8. The device of claim 7, the body portion comprises a grid plate connection point configured for detachably securing the grid plate to the body portion.

9. The device of claim 8, wherein trap door portion comprises a plurality of trap door panels and a plurality of connecting means for releasably securing the trap panels to an underside of the grid plate.

10. The device of claim 8, wherein the trap door portion comprises a closed position and an open position; wherein the closed position is when the trap door portion is flush against an underside of the grid plate such that medication cannot fall through a grid opening.

11. The device of claim 10, wherein the open position is when the trap door panel portion is separated from an underside of the grid plate such that medication can fall through a grid opening in the channel of the handle portion.

12. The device of claim 11, wherein the trap door portion is configured to go from the closed position to an open position when a pressure is exerted on the handle portion effective to separate the trap door portion from the underside of the grid plate.

13. The device of claim 10, further comprising a tension element configured to exert a vertical pressure against the trap door portion effective to maintain the trap door portion in a closed position in the absence of an opposing force.

14. The device of claim 12, wherein the fold lines comprise a living hinge.

15. The device of claim 12, further comprising a grid plate cover configured to cover at least a portion of an outer surface of the grid plate.

16. The device of claim 12, wherein the connecting means comprises a snap fastener, button fastener, and magnet and magnetic metal, or a combination thereof.

17. A method for dispensing medication, the method comprising a. providing the counting device of claim 12;

b. collecting medication within at least one grid opening; and c. dispensing the medication by releasing the medication from the grid opening.

18. The method of claim 17, wherein the counting device is configured to collect medication when the trap door portion is flush against an underside of the grid opening such that medication cannot fall through a grid opening.

19. The method of claim 18, wherein the counting device is configured to release the medication from within a grid opening when the trap door portion is separated from an underside of the grid plate such that medication can fall from within the grid opening.

20. The method of claim 19, dispensing the medication comprises dispensing the medication from within the channel out through an opening at the proximal end of the handle portion of the counting device.

* * * * *